US011143085B2

(12) United States Patent
Mori et al.

(10) Patent No.: US 11,143,085 B2
(45) Date of Patent: Oct. 12, 2021

(54) COOLING STRUCTURE FOR INTERNAL COMBUSTION ENGINE

(71) Applicant: HONDA MOTOR CO., LTD., Tokyo (JP)

(72) Inventors: Kensuke Mori, Wako (JP); Hiroyuki Tsukagoshi, Wako (JP); Koichiro Matsushita, Wako (JP); Reina Kurosu, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 16/523,141

(22) Filed: Jul. 26, 2019

(65) Prior Publication Data

US 2020/0032697 A1 Jan. 30, 2020

(30) Foreign Application Priority Data

Jul. 27, 2018 (JP) ..... JP2018-141415

(51) Int. Cl.
*F01P 7/16* (2006.01)
*F01P 3/02* (2006.01)
(Continued)

(52) U.S. Cl.
CPC ..... *F01P 3/02* (2013.01); *F01P 7/161* (2013.01); *F01P 5/10* (2013.01); *F02F 1/10* (2013.01)

(58) Field of Classification Search
USPC ..... 123/41.01, 41.29, 41.76
See application file for complete search history.

(56) References Cited

U.S. PATENT DOCUMENTS 4,237,847 A * 12/1980 Baugh ..... F02F 1/163 123/193.2
4,284,037 A * 8/1981 Kasting ..... F01P 3/02 123/41.31
(Continued)

FOREIGN PATENT DOCUMENTS

EP 2 644 861 A2 10/2013
JP S58-77113 U 5/1983
(Continued)

OTHER PUBLICATIONS

Office Action issued in the corresponding Japanese Patent Application No. 2018-141415 dated Nov. 26, 2019.
(Continued)

*Primary Examiner* — George C Jin
*Assistant Examiner* — Teuta B Holbrook
(74) *Attorney, Agent, or Firm* — Carrier Blackman & Associates, P.C.; William D. Blackman; Joseph P. Carrier

(57) ABSTRACT

A cooling structure of an internal combustion engine includes a thermostat provided to switch circulation between a radiator passage and a bypass passage in an engine body, to thereby enable acceleration of early warming up via the bypass passage without impairing the external appearance or increasing the size of the internal combustion engine. The cooling structure also includes an in-cylinder-block fluid passage partitioned up and down in an axial direction of a cylinder axis into an in-cylinder-block upper fluid passage and an in-cylinder-block lower fluid passage by a partition wall. The bypass passage is partially composed of the in-cylinder-bock lower fluid passage.

18 Claims, 14 Drawing Sheets

(51) Int. Cl.
*F02F 1/10* (2006.01)
*F01P 5/10* (2006.01)

(56) References Cited

U.S. PATENT DOCUMENTS 4,813,408 A * 3/1989 Katsumoto ..... F01P 3/02 123/196 AB
4,911,109 A * 3/1990 Kawamura ..... F01P 3/02 123/193.3
5,253,615 A * 10/1993 Heater ..... F02F 1/108 123/195 R
6,349,697 B1 * 2/2002 Kanda ..... F02B 17/005 123/295
6,962,131 B2 * 11/2005 Aketa ..... F01P 3/02 123/41.01
2004/0150169 A1 * 8/2004 Matsumoto ..... F16J 15/122 277/591
2005/0056238 A1 * 3/2005 Marinica ..... F02F 1/14 123/41.74
2006/0065218 A1 * 3/2006 Gokan ..... F01P 9/00 123/41.82 R
2007/0200439 A1 * 8/2007 Nagahashi ..... F01M 1/08 310/54
2007/0204828 A1 * 9/2007 Nagahashi ..... F01M 11/02 123/192.2
2008/0066696 A1 * 3/2008 Hirayama ..... F01P 11/0285 123/41.44
2011/0315098 A1 * 12/2011 Kosugi ..... F01P 3/02 123/41.74
2013/0016039 A1 1/2013 Moore et al.
2013/0168039 A1 * 7/2013 Arai ..... B60H 1/00021 165/41
2013/0248273 A1 * 9/2013 Nakamura ..... F28D 1/00 180/229
2014/0196674 A1 * 7/2014 Quix ..... F01P 3/02 123/41.09
2016/0010533 A1 * 1/2016 Matsumoto ..... F01P 7/16 123/41.08
2017/0022876 A1 * 1/2017 Hoshi ..... B60K 11/04
2017/0074152 A1 * 3/2017 Woo ..... F02F 1/36

FOREIGN PATENT DOCUMENTS

JP 63-71411 U 5/1988
JP 370434 A2 * 5/1990
JP 04330322 A * 11/1992
JP 06173682 A * 6/1994
JP 2011-094537 A 5/2011
JP 2013-204525 A 10/2013
JP 2014-047719 A 3/2014
KR 20040043761 A * 5/2004

OTHER PUBLICATIONS

Office Action issued in the corresponding German Patent Application No. 10 2019 119 176.9 dated Jun. 18, 2021, with the English translation thereof.

* cited by examiner

COOLING STRUCTURE FOR INTERNAL COMBUSTION ENGINE

TECHNICAL FIELD

The present invention relates to a cooling structure of an internal combustion engine mounted in a vehicle.

BACKGROUND ART

In one well-known cooling structure for internal combustion engines (see, e.g., Patent Literature 1, for example), a water jacket is provided in a cylinder block and a cylinder head which make up part of the engine body of an internal combustion engine, and a cooling-water circulation path is provided for circulation of cooling water through the water jacket by use of a water pump. A via-radiator passage that passes through a radiator, and a bypass passage that runs around the radiator are installed in the cooling-water circulation path, and a thermostat is used to switch between circulation by way of the via-radiator passage and circulation by way of the bypass passage.

PRIOR ART DOCUMENT

Patent Document

Patent Document 1: JP 2014-47719 A

In a cooling structure of an internal combustion engine disclosed in Patent Document 1, a bypass passage is presented to lead cooling water from a thermostat into a water pump in such manner as to run around a radiator, the thermostat being placed on the left side of a cylinder head, the water pump being placed on the right side of a crankcase.

Therefore, the bypass passage is made up of a cylinder head-side channel portion, a cam chain chamber-side channel portion, and the like. The cylinder head-side channel portion extends rightward from the left-side thermostat on a rear wall of the cylinder head, and the cam chain chamber-side channel portion extends downward from the cylinder head-side channel portion on an inner wall of a cam chain chamber.

SUMMARY OF THE INVENTION

Underlying Problems to be Solved by the Invention

The cylinder head-side channel portion of the bypass passage is formed to have a bulge in the outer wall surface of the rear wall for the purpose of reducing the thickness of the rear wall where a channel of the cylinder head is formed. This may impair the external appearances.

Also, since the cam chain chamber-side channel portion is formed in the inner wall of the cam chain chamber, the cam chain chamber-side channel portion is located between a cam chain and a cylinder bore in the cylinder block. This involves relocating the cam chain to an outward position to avoid the cam chain chamber-side channel portion, and in turn, the cam chain chamber is enlarged. This results in upsizing of the internal combustion engine.

The present invention has been achieved in view of the above-mentioned circumstances, and it is an object thereof to provide a cooling structure of an internal combustion engine to enable acceleration of early warming up by configuring a bypass passage in an engine body without impairing the external appearances of the internal combustion engine and also without an increase in size of the internal combustion engine.

Means to Solve the Problems

In order to achieve the object, according to the present invention, there is provided a cooling structure of an internal combustion engine, in which

- the internal combustion engine is mounted at a center in a left-right vehicle-width direction of a vehicle body between a front wheel and a rear wheel of a motorcycle,
- the internal combustion engine has an engine body configured to place a cylinder block and a cylinder head in this order on a crankcase,
- the cylinder block has an in-cylinder-block fluid passage through which a coolant flows around a cylinder bore,
- the cylinder head has an in-cylinder-head fluid passage through which the coolant flows around a combustion chamber, and
- a via-radiator passage passing through a radiator air-cooling the coolant and a bypass passage bypassing the radiator are installed to a coolant circulation path circulating the coolant through the in-cylinder-block fluid passage and the in-cylinder-head fluid passage by a coolant pump,
- the cooling structure of the internal combustion engine, comprising a thermostat provided to switch between a circulation by way of the via-radiator passage and a circulation by way of the bypass passage,
- wherein the in-cylinder-block fluid passage is partitioned up and down in an axis direction of a cylinder axis into an in-cylinder-block upper fluid passage and an in-cylinder-block lower fluid passage by a partition wall, the cylinder axis being a central axis of the cylinder bore, and
- the bypass passage is partially composed of the in-cylinder-bock lower fluid passage.

According to the feature, in the in-cylinder-block fluid passage through which the coolant flows around the cylinder bores of the cylinder block, the in-cylinder-block lower fluid passage is defined by the partition wall. By use of the in-cylinder-block lower fluid passage as the bypass passage, the bypass passage can be formed in the wall of the cylinder block without an increase in the size of the internal combustion engine. This contributes to the achievement of space savings and enhancement in external appearances.

Further, the in-cylinder-block lower fluid passage, which is formed around the cylinder bores of the cylinder block, is used as the bypass passage. Because of this, when the internal combustion engine is started, the coolant flowing in the bypass passage can be early warmed to warm up the internal combustion engine early.

In a preferred embodiment according to the present invention,

- the in-cylinder-block lower fluid passage is formed in a ring shape surrounding an outer periphery of the cylinder bore of the cylinder block.

According to the feature, the in-cylinder-block lower fluid passage serving as the bypass passage is formed in a ring shape surrounding the outer periphery of the cylinder bores of the cylinder block. Because of this, the coolant flowing in the bypass passage efficiently receives heat to achieve an early rise in temperature. This results in more acceleration of early warming up.

In a preferred embodiment according to the present invention:

the radiator has radiator tanks situated left and right on opposite sides of a radiator core, and the radiator is placed in front of the internal combustion engine, the thermostat and the coolant pump are placed separately on left and right sides in the left-right vehicle-width direction of the engine body, the thermostat on either left or right side of the engine body, and the radiator tank on the same left or right side are connected to each other through a coolant piping, and the coolant pump on the other left or right side of the engine body and the radiator tank on the same left or right side are connected to each other through a coolant piping.

According to the feature, the radiator, which is placed in front of the internal combustion engine, is a side tank radiator that has the radiator tanks situated left and right on opposite sides of the radiator core. The thermostat on one of the left and right sides of the engine body, and the radiator tank on the same left or right side are connected to each other through the coolant piping. The coolant pump on the other left or right side of the engine body, and the radiator tank on the same left or right side are connected to each other through the coolant piping. Because of this, the coolant piping on each of the left and right sides can be made as short as possible.

In a preferred embodiment according to the present invention, the partition wall partitioning the in-cylinder-block fluid passage is located closer to the crankcase than a midpoint of a piston-top motion range of motion of a piston top of a piston that slides in the cylinder bore of the cylinder block in the axis direction of the cylinder axis.

According to the feature, the partition wall, which partitions the in-cylinder-block channel, is formed in a location closer to the crankcase than a midpoint of the piston-top motion range of motion of the piston top of the piston that slides in the direction of the cylinder axis within the cylinder bore of the cylinder block. Because of this, the in-cylinder-block upper channel has a greater capacity than that of the in-cylinder-block lower channel, and, during normal operation after the warming up of the internal combustion engine, the cooling water routed through the radiator flows through the in-cylinder-block upper channel with a greater capacity, and thereby the cylinder block can be cooled efficiently.

In a preferred embodiment according to the present invention, the in-cylinder-block upper fluid passage and said in-cylinder-head fluid passage communicate with each other via a communication hole of a gasket which is sandwiched between the cylinder block and the cylinder head, and the thermostat has a thermostat case that is integrally formed in said cylinder head in an outflow section of the in-cylinder-head fluid passage.

According to the feature, the in-cylinder-block upper fluid passage and the in-cylinder-head fluid passage communicate with each other through the communication hole of the gasket, and the thermostat case of the thermostat is integrally formed in the cylinder head in the outflow section of the in-cylinder-head fluid passage. Because of this, a reduction in the component count can be enabled, and also the thermostat can be installed in the cylinder head in a compact manner, and thereby an increase in the size of the internal combustion engine can be inhibited.

In a preferred embodiment according to the present invention, the thermostat is operative to cause the coolant flowing out from the in-cylinder-head fluid passage to flow to either the via-radiator passage or the bypass passage in a selective manner, and the in-cylinder-head fluid passage includes an escape passage through which a portion of the coolant flowing out from the in-cylinder-head fluid passage escapes into the bypass passage at all times.

According to the feature, the thermostat causes the coolant flowing out from the in-cylinder-head fluid passage to flow to either the via-radiator passage or the bypass passage in a selective manner, and the in-cylinder-head fluid passage includes the escape passage through which a portion of the coolant flowing out from the in-cylinder-head passage escapes into the bypass passage at all times. Because of this, during normal operation after the warming up of the internal combustion engine, even when the thermostat causes the coolant to flow into the via-radiator passage, but not into the bypass passage, a portion of the coolant is caused to flow from the escape passage into the in-cylinder-block lower fluid passage serving as the bypass passage. Thus, stagnation of the coolant can be avoided to prevent the coolant in the in-cylinder-block lower fluid passage from coming to a boil.

In a preferred embodiment according to the present invention, the in-cylinder-block lower fluid passage serving as part of the bypass passage has a lower fluid passage inlet formed therein, and the lower fluid passage inlet is formed in either a front wall or a rear wall of the cylinder block.

According to the feature, the lower fluid passage inlet in the in-cylinder block lower fluid passage serving as part of the bypass passage is formed in either the front wall or the rear wall of the cylinder block. Because of this, an increase in size in the left-right, vehicle-width direction of the internal combustion engine can be inhibited.

In a preferred embodiment according to the present invention, the in-cylinder-block lower fluid passage has a lower fluid passage outlet formed therein, the in-cylinder-block upper fluid passage has an upper fluid passage inlet formed therein, and the lower fluid passage outlet and the upper fluid passage inlet are formed adjacent to each other in the front wall of the cylinder block, and the lower fluid passage outlet is connected to a lower fluid passage outflow connection tube, the upper fluid passage inlet is connected to an upper fluid passage inflow connection tube, and the lower fluid passage outflow connection tube and the upper fluid passage inflow connection tube are integrally formed.

According to the feature, the lower fluid passage outflow connection tube connected to the lower fluid passage outlet of the in-cylinder-block lower fluid passage, and the upper fluid passage inflow connection tube connected to the upper fluid passage inlet of the in-cylinder-block upper fluid passage are integrally formed. Because of this, a reduction in component count and an improvement in mountability can be achieved.

In a preferred embodiment according to the present invention, the coolant flowing out from the radiator is led by a radiator outflow piping, the coolant flows back to the coolant pump through a pump inflow piping, a branch connection tube is connected between the radiator outflow piping and the pump inflow piping, and the branch connection tube integrally has the lower fluid passage outflow connection tube as a branch tube portion of the branch connection tube.

According to the feature, the branch connection tube is connected between the radiator outflow piping and the pump inflow piping through which the coolant flows back to the coolant pump, and the branch connection tube integrally has the lower fluid passage outflow connection tube as a branch tube portion of the branch connection tube. This results in integral forming of: the branch connection tube connected between the radiator outflow piping and the pump inflow piping; the lower fluid passage outflow connection tube; and the upper fluid passage inflow connection tube. And, a reduction in component count and an improvement in mountability can be achieved.

In a preferred embodiment according to the present invention, the engine body is configured to place the cylinder block and the cylinder head in this order on the crankcase and then to fasten the crankcase, the cylinder block and the cylinder head together with stud bolts, and the in-cylinder-block lower fluid passage serving as a part of the bypass passage extends on an outward side of the stud bolts opposite to the cylinder bore with respect to the stud bolt.

According to the feature, the in-cylinder-block lower fluid passage serving as part of the bypass passage extends on the outward side of the stud bolts, namely, on the opposite side of the stud bolts from the cylinder bores. Because of this, the greater rigid fastening is accomplished with the stud bolts on the lower side of the cylinder block attached to the crankcase, so that the cylinder block can be securely attached to the crankcase. And also, greater rigidity and uniform surface pressure can be achieved on the gasket surface between the crankcase and the cylinder block to improve the sealing characteristics.

Advantageous Effects of the Invention

With the features of the present invention, the in-cylinder-block lower fluid passage of the in-cylinder-block fluid passage through which the coolant flows around the cylinder bores of the cylinder block is used as part of the bypass passage. Because of this, the bypass passage can be configured in the wall of the cylinder block without an increase in the size of the internal combustion engine. This contributes to the achievement of space savings and enhancement in external appearances.

Further, the in-cylinder-block lower fluid passage, which is formed around the cylinder bores of the cylinder block, is used as the bypass passage. Because of this, when the internal combustion engine is started, the coolant flowing in the bypass passage can be early warmed to warm up the internal combustion engine early.

MODE FOR CARRYING OUT THE INVENTION

An embodiment according to the present invention will now be described with reference to the accompanying drawings.

Figure 1:
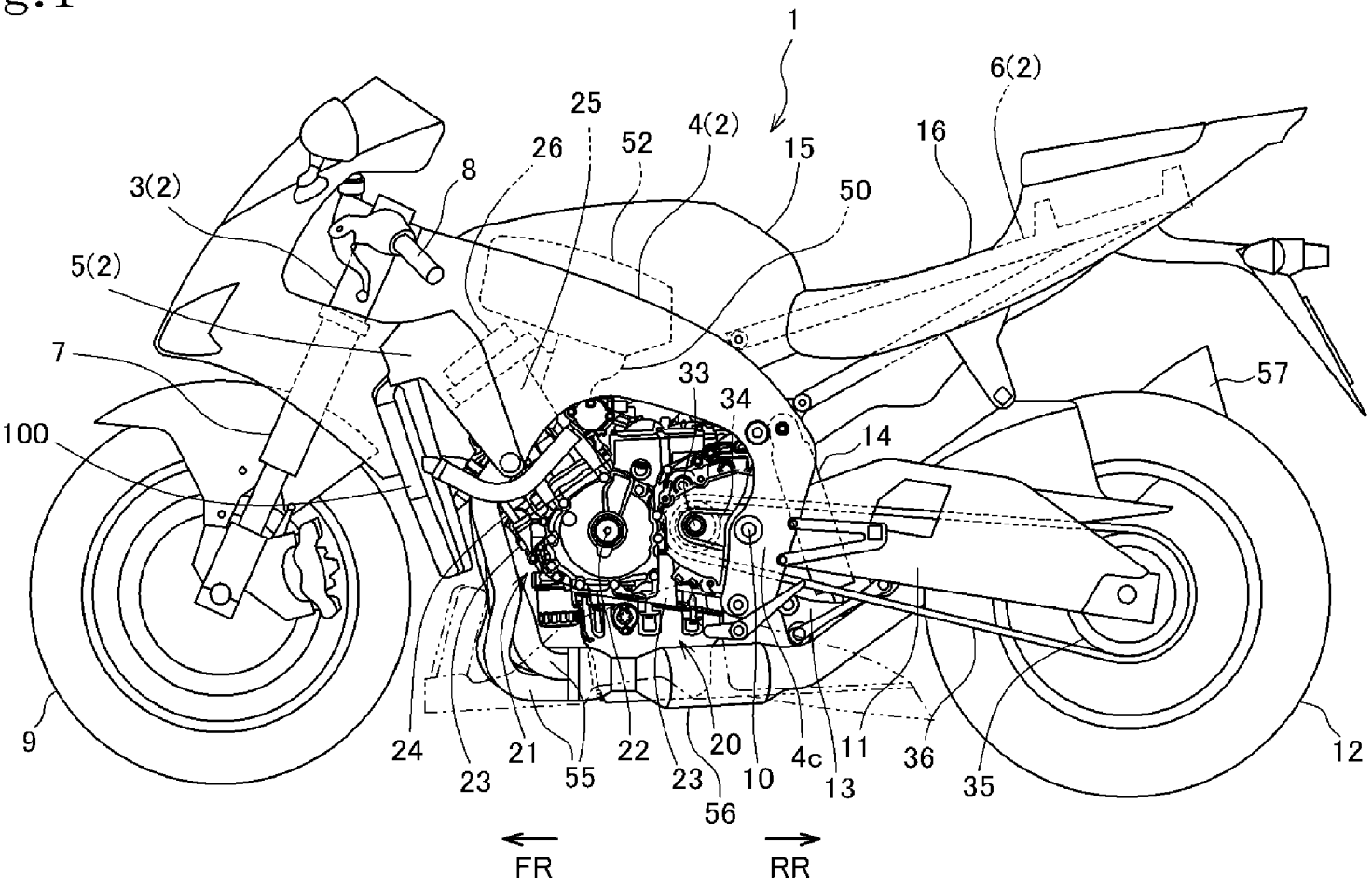
FIG. 1 is an overall side view of a motorcycle according to an embodiment of the present invention.

FIG. 1 is a side view of a motorcycle 1 which is a saddle riding vehicle according to an embodiment to which the present invention is applied.

It is noted that, throughout the description of the specification, front, rear, left, and right directions/orientations are used on the basis of commonly used in which the straight-ahead direction of the motorcycle 1 according to the embodiment is a forward direction, and, in each drawing, a reference sign FR denotes the front, a reference sign RR denotes the rear, a reference sign LH denotes the left, and a reference sign RH denotes the right.

A body frame 2 of the saddle riding type motorcycle 1 includes main frames 4, 4 separated into right and left extend rearward from a head pipe 3. The main frames 4, 4 have respectively center frame portions 4*c*, 4*c* at the rear, the center frame portions 4*c*, 4*c* bending downward.

Further, down frames 5, 5 extend obliquely downward to the rear from the head pipe 3.

A seat rail 6 extends obliquely upward to the rear from locations forward of upper bends of the respective center frame portions 4*c*, 4*c* of the main frames 4, 4.

The head pipe 3 steerably supports a front fork 7, and in turn, the front fork 7 pivotally supports, at its lower end, a front wheel 9. A handlebar 8 is coupled to the front fork 7 through a steering shaft (not shown) extending upward from the front fork 7.

Also, a rear fork 11 having a front end pivotally supported to the center frame portion 4*c* through a pivot shaft 10 extends rearward. Then, the rear fork 11 pivotally supports, at its rear end, a rear wheel 12 that is mounted in a vertically swingable manner.

A link mechanism 13 is interposed between a lower side edge of the rear fork 11 and a lower end of the center frame portion 4*c*. A rear cushion 14 is interposed between a part of the link mechanism 13 and an upper portion of the center frame portion 4*c*.

A power unit 20 is mounted on the body frame 2 of the motorcycle 1, and the power unit 20 includes an internal combustion engine 21 in which a transmission 31 is integrally housed in a rear portion of a crankcase 23. The power unit 20 is suspended by the main frames 4 and the down frame 5 in front of the main frames 4.

A fuel tank 15 is placed between the main frames 4 above the power unit 20. A seat 16 is disposed rearward of the fuel tank 15 and the seat 16 is supported by the seat rail 6.

The internal combustion engine 21 is an in-line four-cylinder, four stroke cycle, water-cooled internal combustion engine, and the internal combustion engine 21 is mounted on the motorcycle 1 with a crankshaft 22 oriented in a vehicle width direction (left-right direction).

Figure 2:
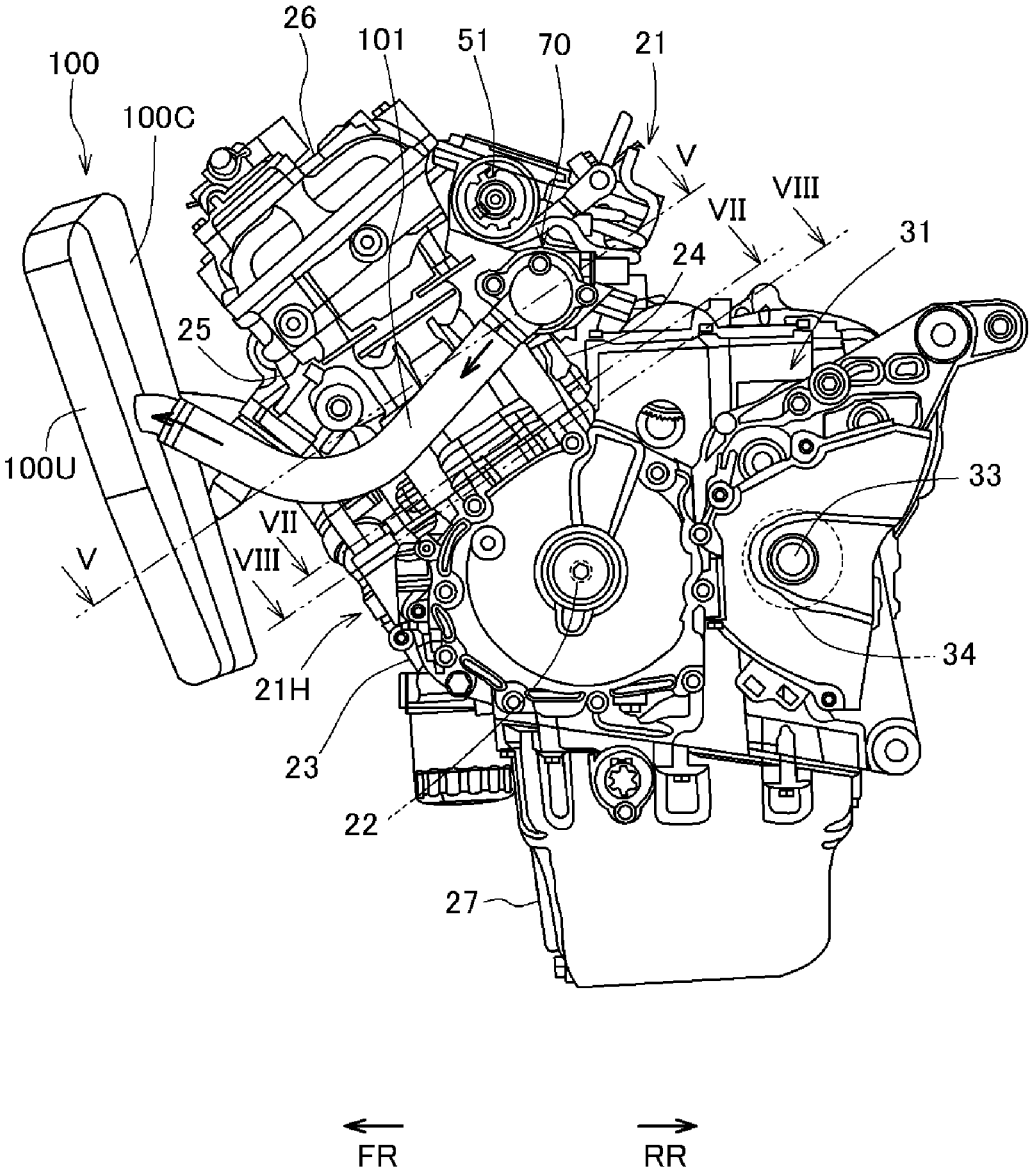
FIG. 2 is a left side view of an internal combustion engine (power unit) and a radiator which are mounted on the motorcycle.
Figure 3:
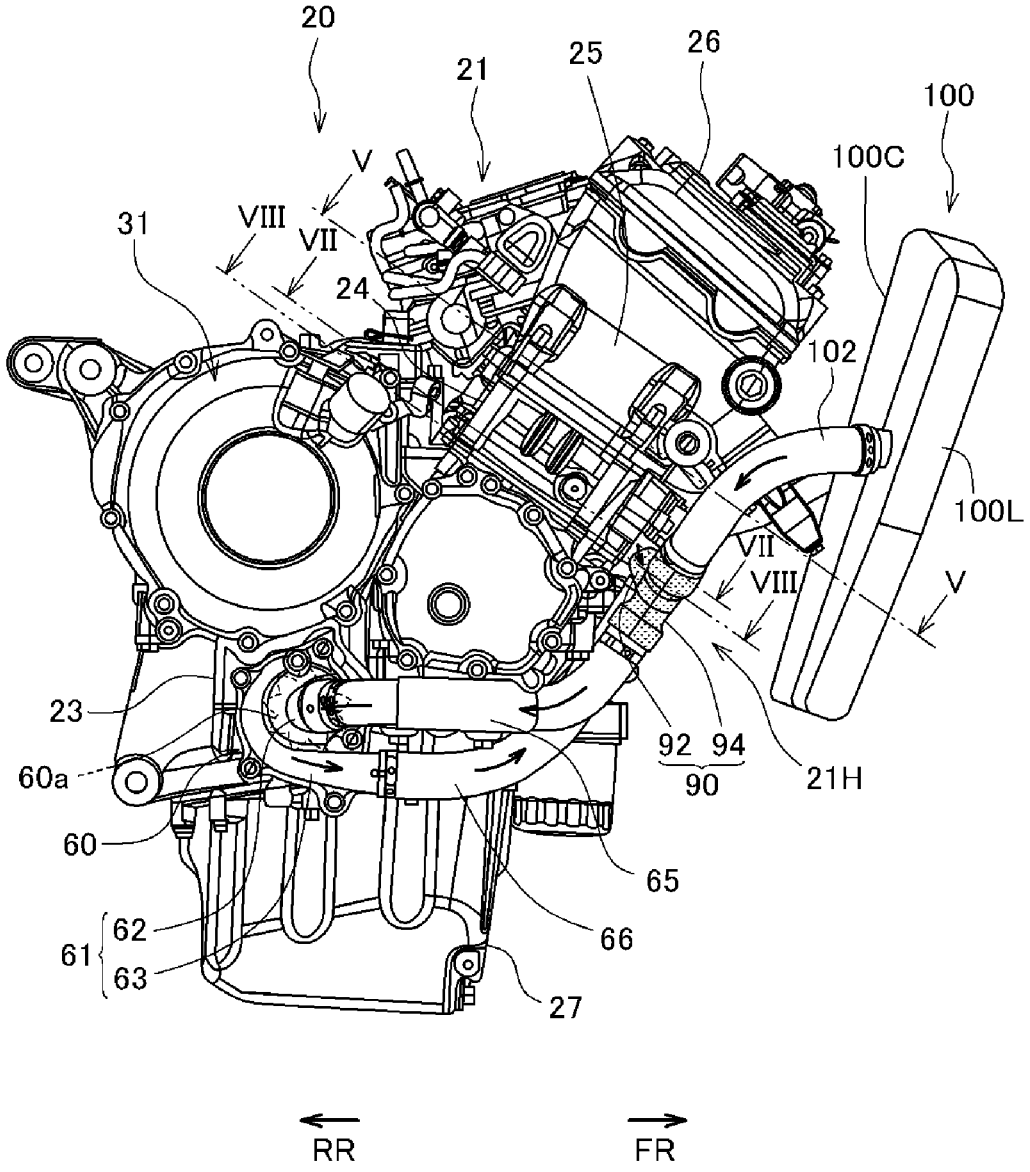
FIG. 3 is a right side view of the same.
Figure 4:
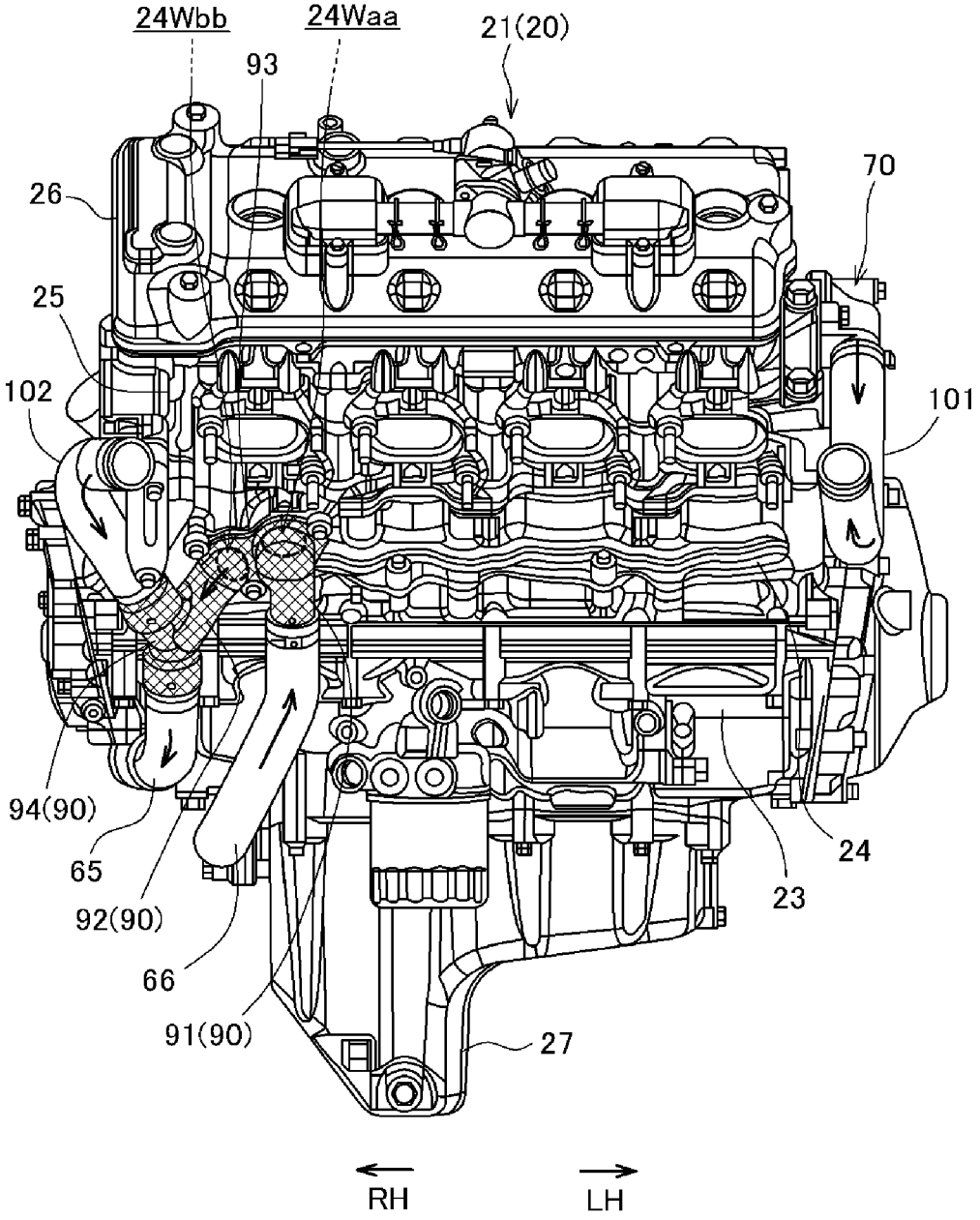
FIG. 4 is a front view of the internal combustion engine (power unit).

FIG. 2 illustrates a left side of the internal combustion engine 21. FIG. 3 illustrates a right side of the internal combustion engine 21. FIG. 4 is a front view of the internal combustion engine 21.

Referring to FIG. 2 and FIG. 3, an engine body 21H is configured in such a manner that the crankcase 23 axially supports the crankshaft 22 in a rotatable manner, and a cylinder block 24 and a cylinder head 25 are stacked in this order on the crankcase 23 while the cylinder axis is tilted slightly forward, and in this upright position, the cylinder block 24 and the cylinder head 25 are fastened together to the crankcase 23 by stud bolts 40. Then, a cylinder head cover 26 covers the cylinder head 25.

A gasket 25*c* is sandwiched between the cylinder block 24 and cylinder head 25.

An oil pan 27 covers the bottom of the crankcase 23.

An intake pipe 50 extends upward from the forward tilting cylinder head 25 of the internal combustion engine 21. The intake pipe 50 is connected via a throttle body 51 to an air cleaner 52 (see FIG. 1).

And, four exhaust pipes 55 extend out from the cylinder head 25 toward the front and then the four exhaust pipes 55 extend downward. Then, the four exhaust pipes 55 are collected in a place where the four exhaust pipes 55 are bent rearward. Then, the exhaust pipe 55 thus collected extends rearward under the crankcase 23 and is connected to a muffler 57 placed along the right side of the rear wheel 12 via a catalyst device 56 (see FIG. 1).

The transmission 31 includes a counter shaft 33 that is an output shaft of the power unit 20. The counter shaft 33 passes through a left bearing wall to protrude leftward, and an output sprocket 34 is fitted over the left end of the counter shaft 33. Then, a drive chain 36 is wound around between the output sprocket 34 and a driven sprocket 35 that is fitted over a rear axle of the rear wheel 12. Thus, the output of the power unit 20 is transferred via the driven chain 36 to the rear wheel 12 to cause the motorcycle 1 to travel (see FIG. 1).

A radiator 100 expands in the left-right, vehicle-width direction in front of the internal combustion engine 21. The radiator 100 is disposed of in a forward tilting position along the front surfaces of the forward tilting cylinder block 24 and the forward tilting cylinder head 25 which are of the engine body H.

The radiator 100 has an upstream radiator tank 100U and a downstream radiator tank 100L which are situated left and right on opposite sides of a radiator core 100C.

Referring to FIG. 7 to FIG. 10 which illustrate the cylinder block 24, the cylinder block 24 has four cylindrical-shaped cylinder bores 24*b* formed therein to be arranged in the left-right, vehicle-width direction, and also the cylinder block 24 has a rectangular-shaped cam chain chamber 24*c* formed therein on the right side of the cylinder bores 24*b*.

Figure 12:
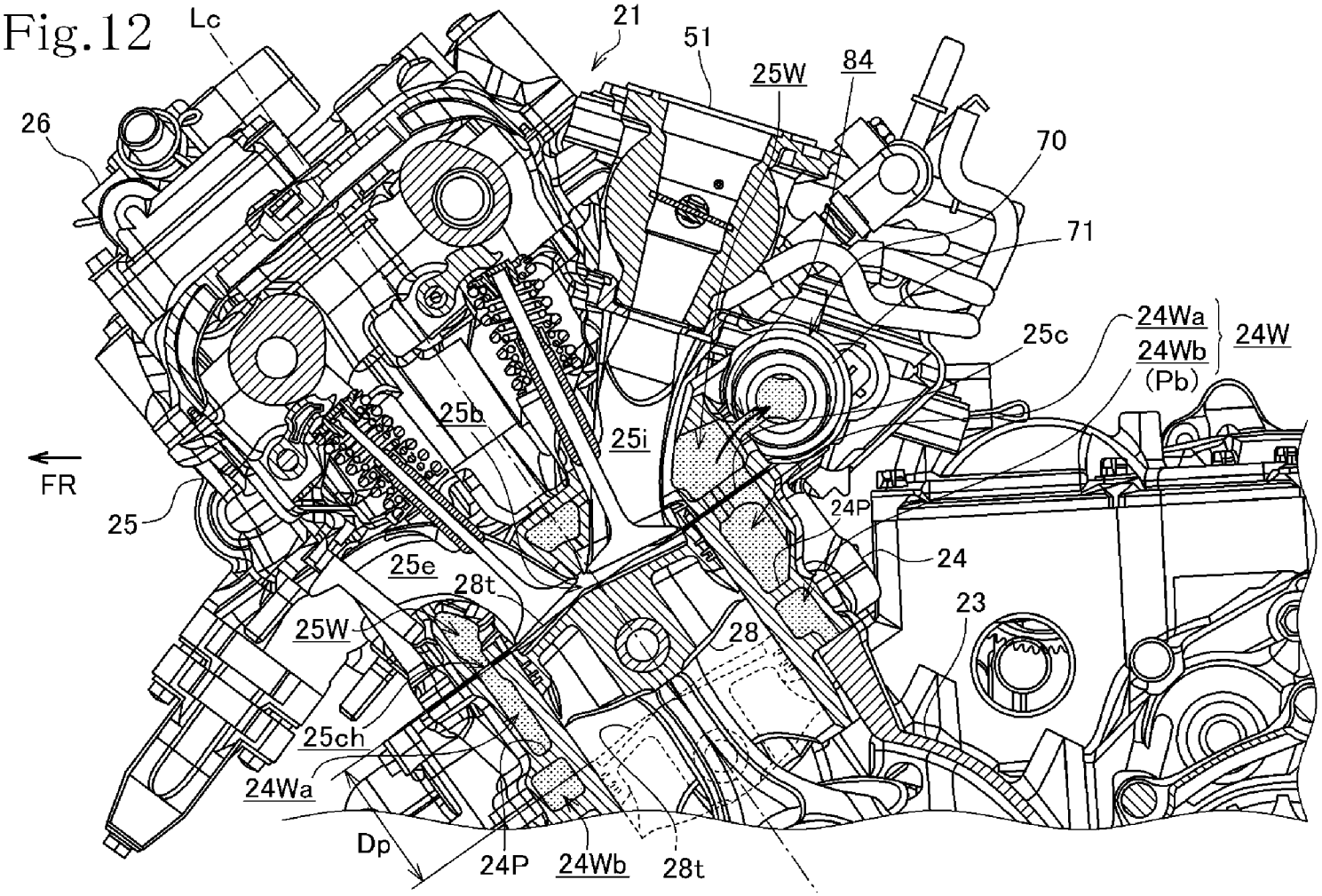
FIG. 12 is a sectional view of the internal combustion engine taken along arrows XII-XII of FIG. 5, FIG. 7 and FIG. 8.

Pistons 28 reciprocatively slide in the cylinder axis direction within the respective cylinder bores 24*b* (see FIG. 12).

A ring-shaped in-cylinder-block channel (cylinder-block water jacket) 24W is formed in a portion located above the crankcase 23 such that the in-cylinder-block channel 24W surrounds the outer periphery of the four cylinder bores 24*b* arranged from side to side within the cylinder block 24.

Figure 13:
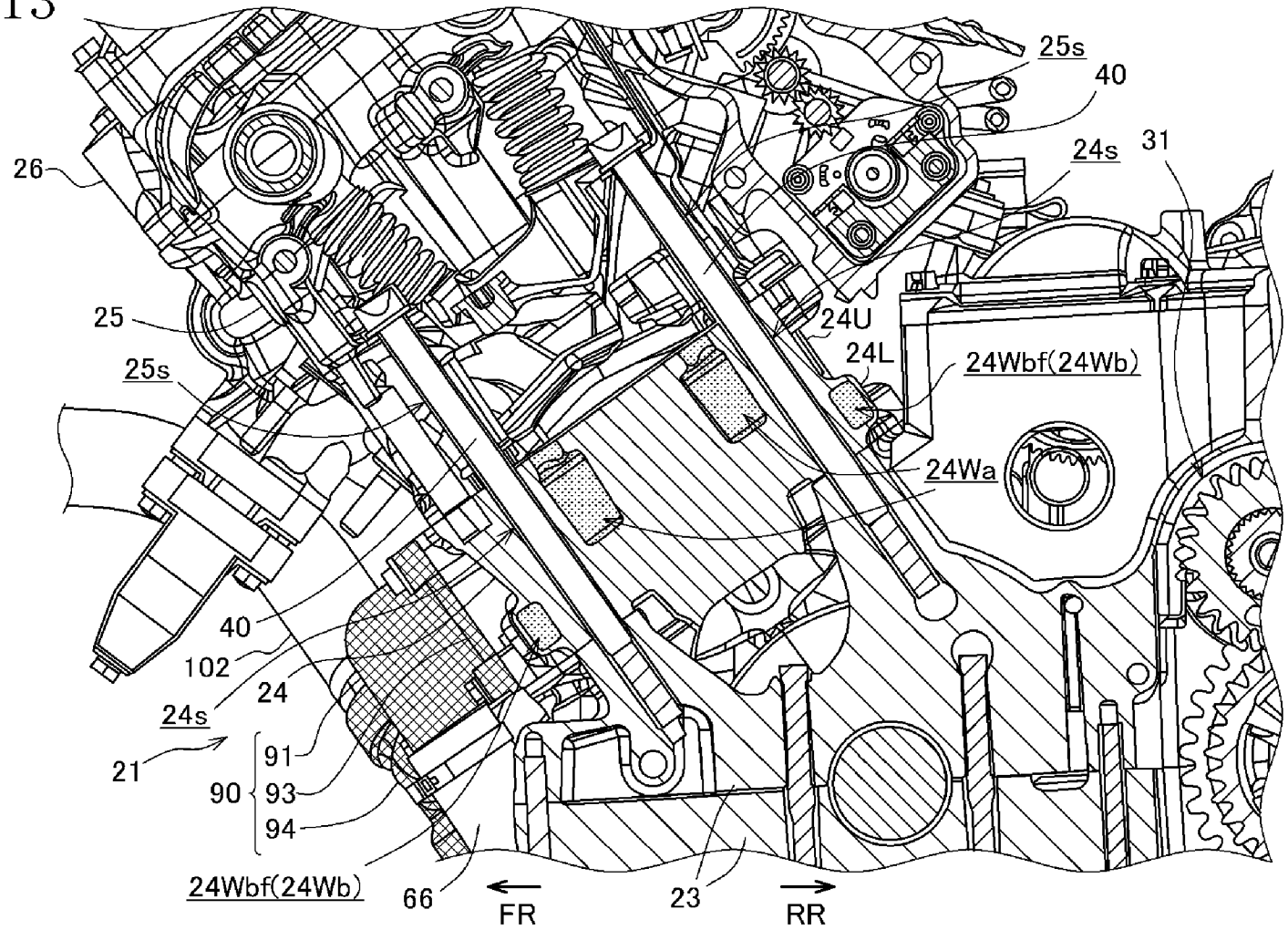
FIG. 13 is a sectional view of the internal combustion engine taken along arrows XIII-XIII of FIG. 5, FIG. 7 and FIG. 8.

As illustrated in FIG. 12 and FIG. 13, the in-cylinder-block channel 24W is partitioned up and down in the direction of the cylinder axis Lc by a partition wall 24P to form an in-cylinder-block upper channel 24Wa and an in-cylinder-block lower channel 24Wb.

Referring to FIG. 12, the partition wall 24P, which partitions the in-cylinder-block fluid passage 24W, is formed in a location closer to the crankcase 23 than a midpoint of a piston-top motion range Dp of motion of a piston top 28*t* of a piston 28 sliding in each cylinder bore 24*b* in the direction of the cylinder axis Lc.

Figure 11:
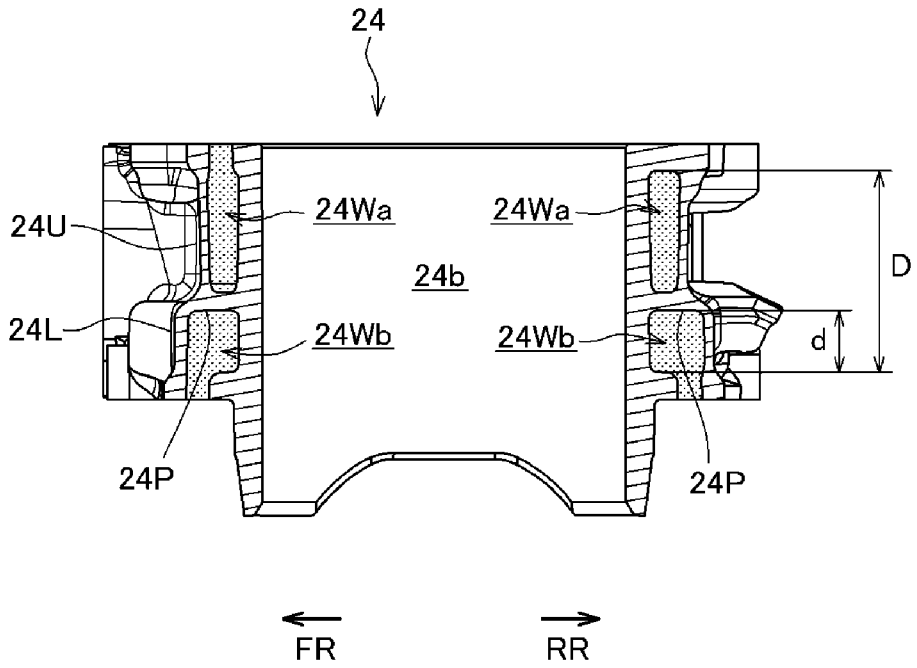
FIG. 11 is a sectional view of the cylinder block taken along arrows XI-XI of FIG. 9 and FIG. 10.

As illustrated in FIG. 11, the in-cylinder-block lower channel 24Wb has a width d in the direction of the cylinder axis Lc and the in-cylinder-block channel 24W has a width D in the direction of the cylinder axis Lc. And, the width d of the in-cylinder-block lower channel 24Wb is the order of about one-third of the width D of the in-cylinder-block channel 24W.

Figure 7:
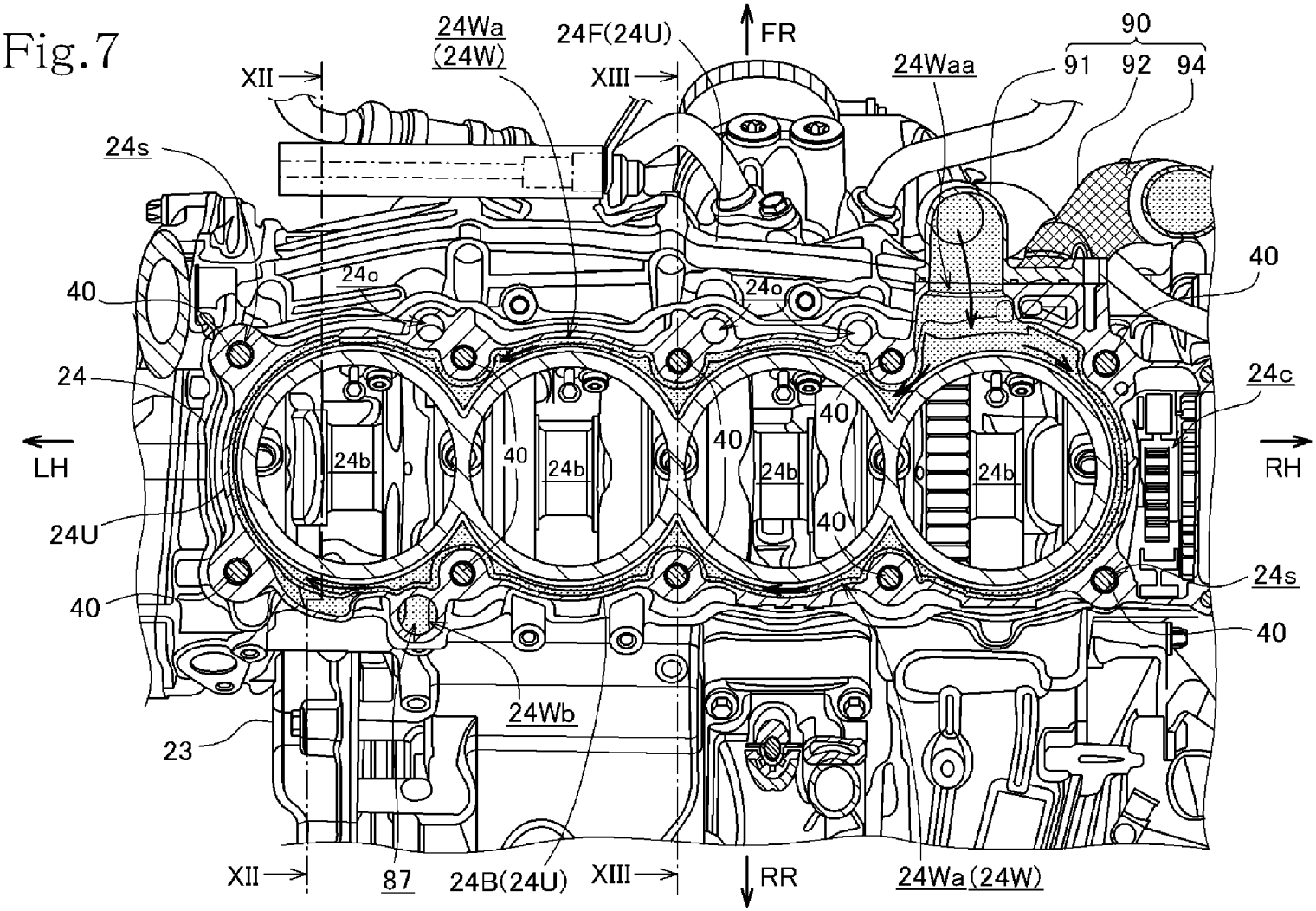
FIG. 7 is a sectional view of the internal combustion engine corresponding to a cylinder block taken along arrows VII-VII of FIG. 2 and FIG. 3.
Figure 8:
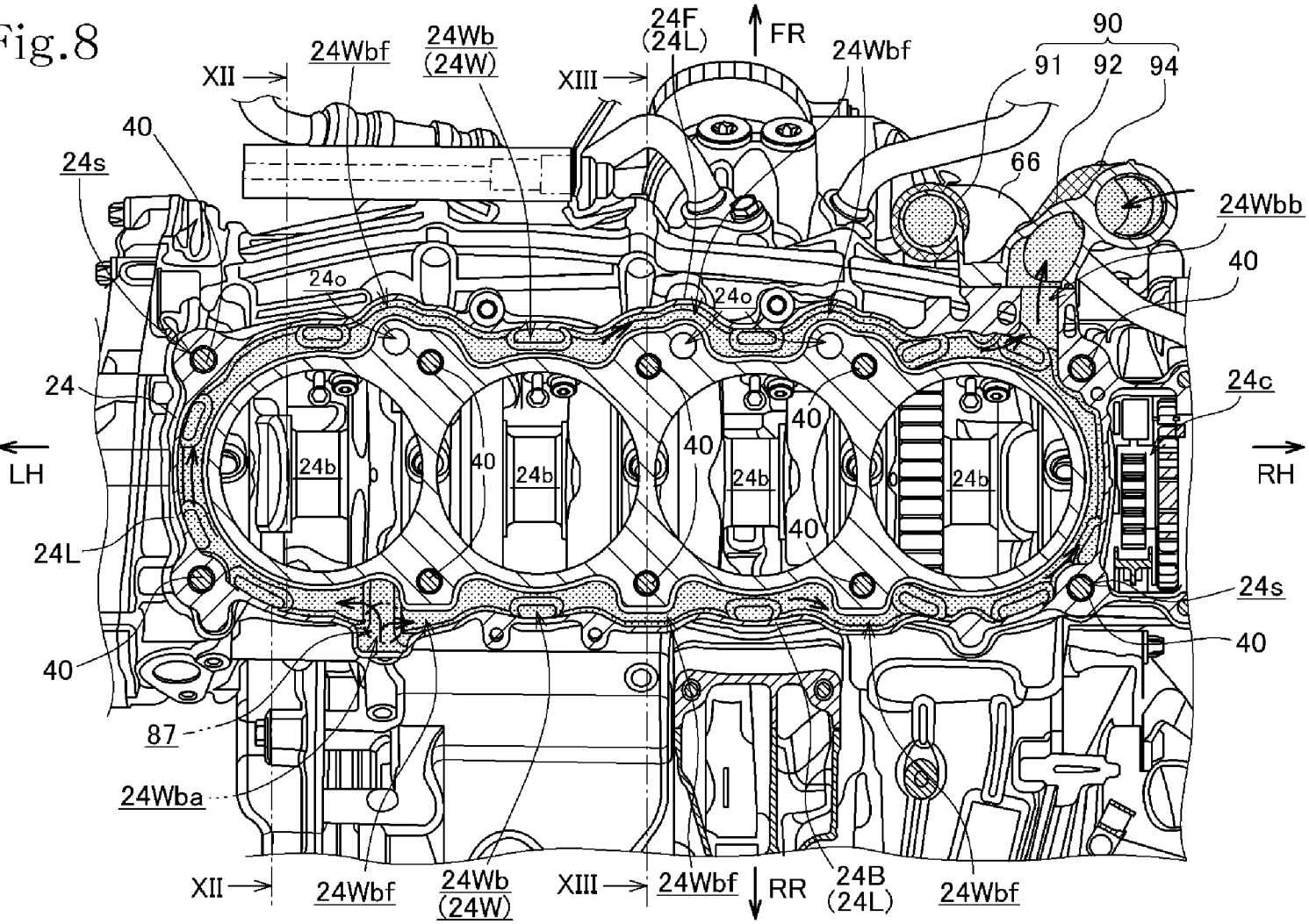
FIG. 8 is a sectional view of the internal combustion engine corresponding to the cylinder block taken along arrows VIII-VIII of FIG. 2 and FIG. 3

Reference is made to FIG. 7 illustrating the in-cylinder-block upper channel 24Wa and FIG. 8 illustrating the in-cylinder-block lower channel 24Wb. The in-cylinder-block upper channel 24Wa and the in-cylinder-block lower channel 24Wb are formed in a ring shape to surround the outer periphery of the four cylinder bores 24*b* arranged from side to side within the cylinder block 24.

In the outer periphery of the four cylinder bores 24*b* arranged from side to side, bolt holes 24*s* through which the stud bolts 40 pass are formed at four corners of the outer periphery of each cylinder bore 24*b*, so that the periphery of each cylinder bore 24*b* is fastened by use of the four stud bolts 40.

It is noted that in an overlap part of the outer peripheries of both of adjacent cylinder bores 24*b*, 24*b*, a common bolt hole 24*s* is formed in a position making inroad slightly into an area between the adjacent cylinder bores 24*b*, 24*b*, and the two front and rear stud bolts 40 pass through the common bolt holes 24*s*.

Figure 5:
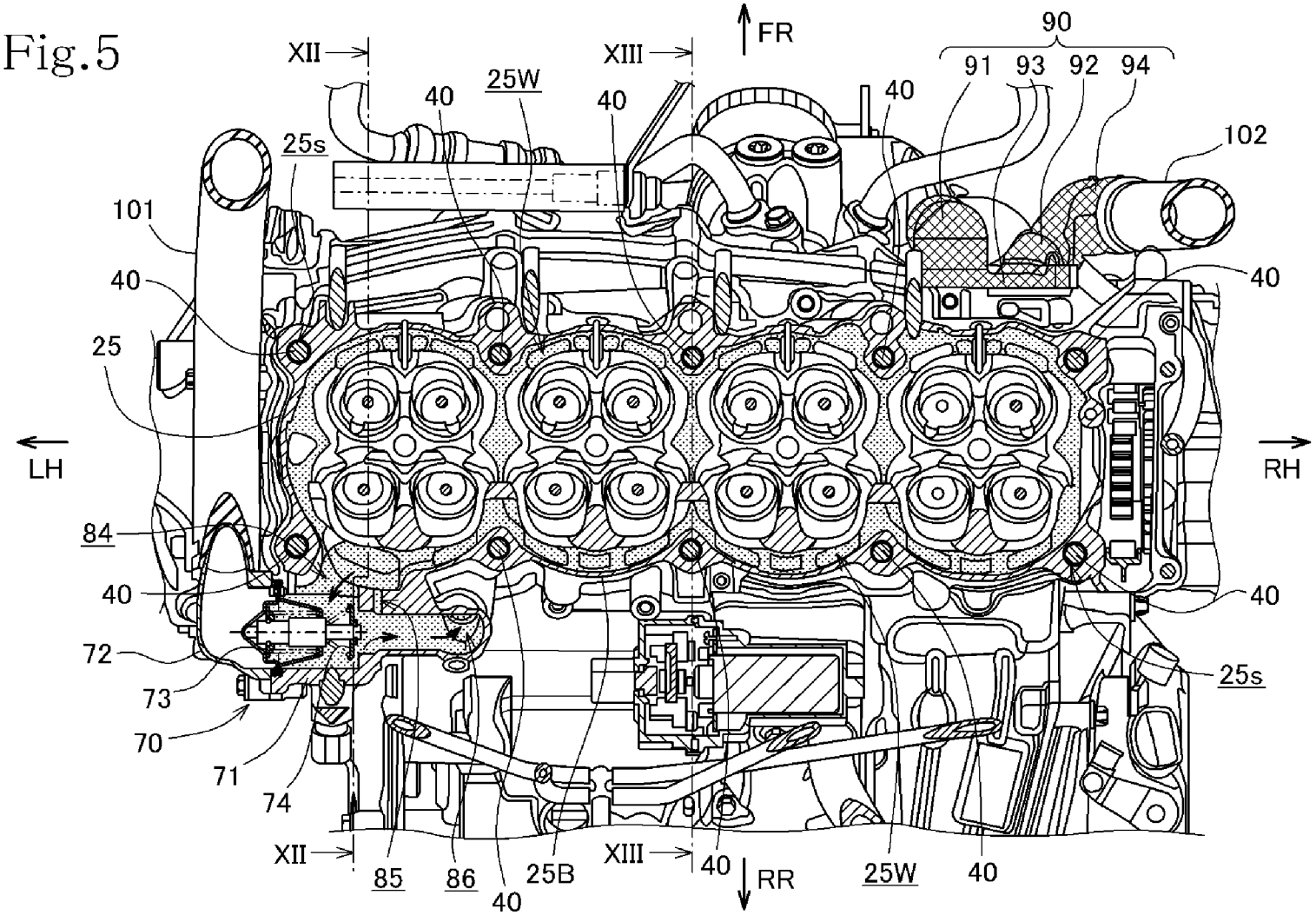
FIG. 5 is a sectional view of the internal combustion engine corresponding to a cylinder head taken along arrows V-V of FIG. 2 and FIG. 3.

As illustrated in FIG. 5, the cylinder head 25 also has bolt holes 25*s* formed therein in corresponding positions to allow for the passage of the stud bolts 40.

Therefore, as illustrated in FIG. 7 and FIG. 8, the five bolt holes 24*s* are formed from side to side in each of a front wall and a rear wall of the cylinder block 24. Thus, the total ten stud bolts 40, which pass through the respective bolt holes 24*s*, are used to fasten the cylinder block 24 and the cylinder head 25 to the crankcase 23.

Also, as illustrated in FIG. 7 and FIG. 8, oil passages 24*o* are formed in the front wall of the cylinder block 24 to supply oil to a valve system of the cylinder head 25. The oil passages 24*o* are respectively located obliquely in front of the inner three bolt holes 24*s* of the five bolt holes 24*s* arranged from side to side.

The partition wall 24P defines the in-cylinder-block upper channel 24Wa on the upper side of the in-cylinder-block channel 24W. Then, as illustrated in FIG. 7, the in-cylinder-block upper channel 24Wa is formed to extend on the inward side of the stud bolts 40, namely, on the same side as the cylinder bores 24*b* with respect to the stud bolts 40. Thus, the in-cylinder-block upper channel 24Wa is formed to surround the outer periphery of the cylinder bores 24*b*.

It is noted that the in-cylinder-block upper channel 24Wa also extends on the inward side of the oil passages 24*o*, namely, on the same side as the cylinder bores 24*b* with respect to the oil passages 24*o*.

Meanwhile, as illustrated in FIG. 8, the in-cylinder-block lower channel 24Wb on the lower side of the in-cylinder-block channel 24W is formed to extend in a bulge passage portion 24Wbf that bulges outward of the six stud bolts 40 located inward in the left-right direction, that is, the bulge passage portion 24Wbf that bulges toward the opposite side of the stud bolts 40 from the cylinder bores 24*b*. Thus, the in-cylinder-block lower channel 24Wb is formed to surround the outer periphery of the cylinder bores 24*b*.

It is noted that the bulge passage portion 24Wbf of the in-cylinder-block lower channel 24Wb also extends on the outward side of the stud bolts 40, namely, on the opposite side of the oil passages 24*o* from the cylinder bores 24*b*.

Therefore, as illustrated in FIG. 11 and FIG. 13, the cylinder block 24 includes a lower perimeter wall 24L in which the in-cylinder-block lower channel 24Wb is formed, and the lower perimeter wall 24L is formed to be widened more outward than an upper perimeter wall 24U in which the in-cylinder-block upper channel 24Wa is formed.

Referring to FIG. 5 and FIG. 12, the cylinder head 25 has an in-cylinder-head channel (cylinder-head water jacket) 25W formed therein around combustion chambers 25*b* corresponding to the cylinder bores 24*b* of the cylinder block 24.

In the cylinder head 25, an intake port 25*i* bends and extends out in an obliquely upward and rearward direction from each of the combustion chambers 25*b*, and the throttle body 51 is connected to an upstream end of the intake port 25*i*.

Also, an exhaust port 25*e* extends out in an obliquely upward and forward direction from each of the combustion chambers 25*b*, and the exhaust pipe 55 is connected to the exhaust port 25*e*.

The in-cylinder-head channel (cylinder-head water jacket) 25W is also formed around the intake ports 25*i* and the exhaust ports 25*e*.

The in-cylinder-head channel 25W of the cylinder head 25 partially opens onto a mating face with the cylinder block 24.

Figure 9:
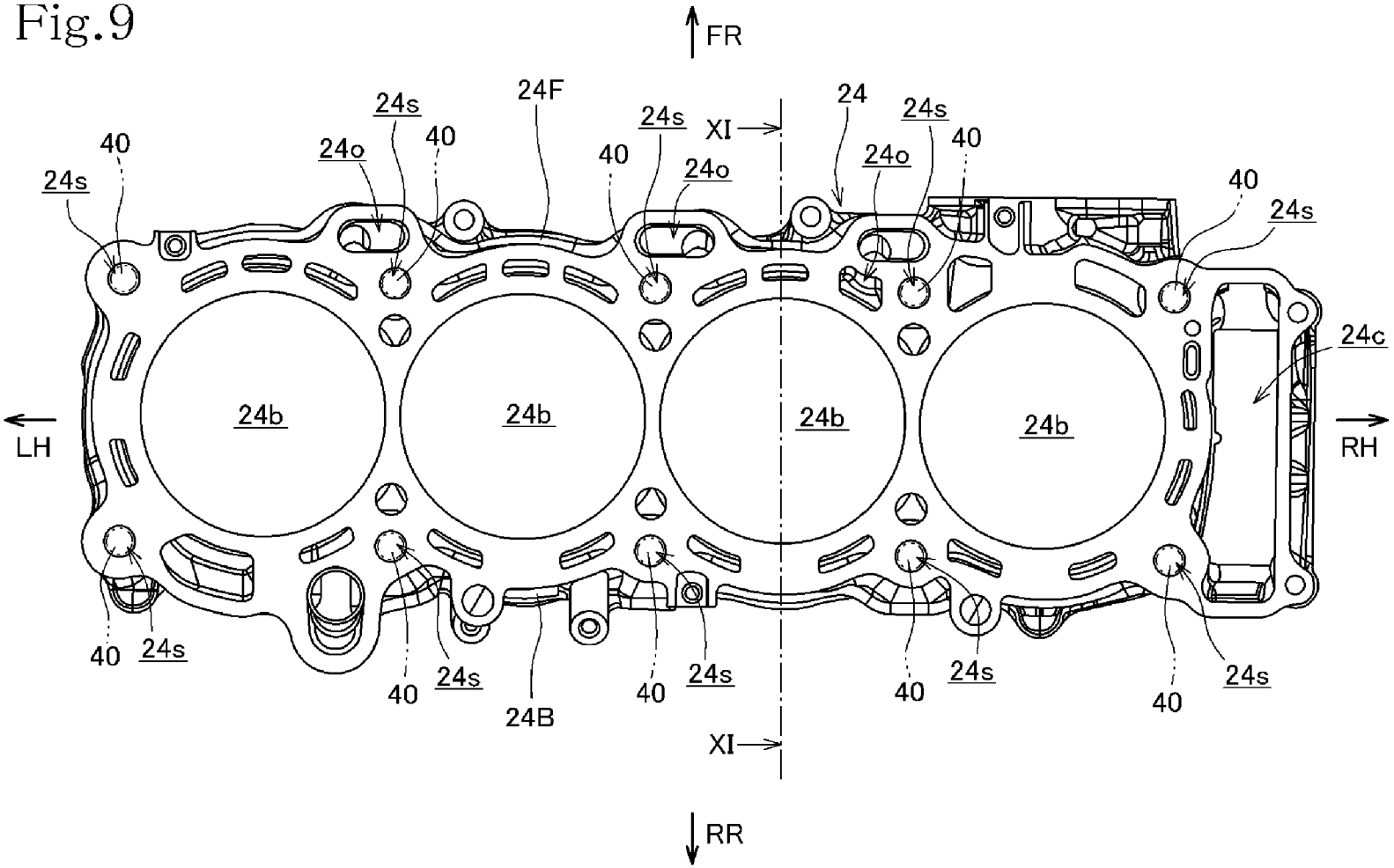
FIG. 9 is a top view of the cylinder block.
Figure 10:
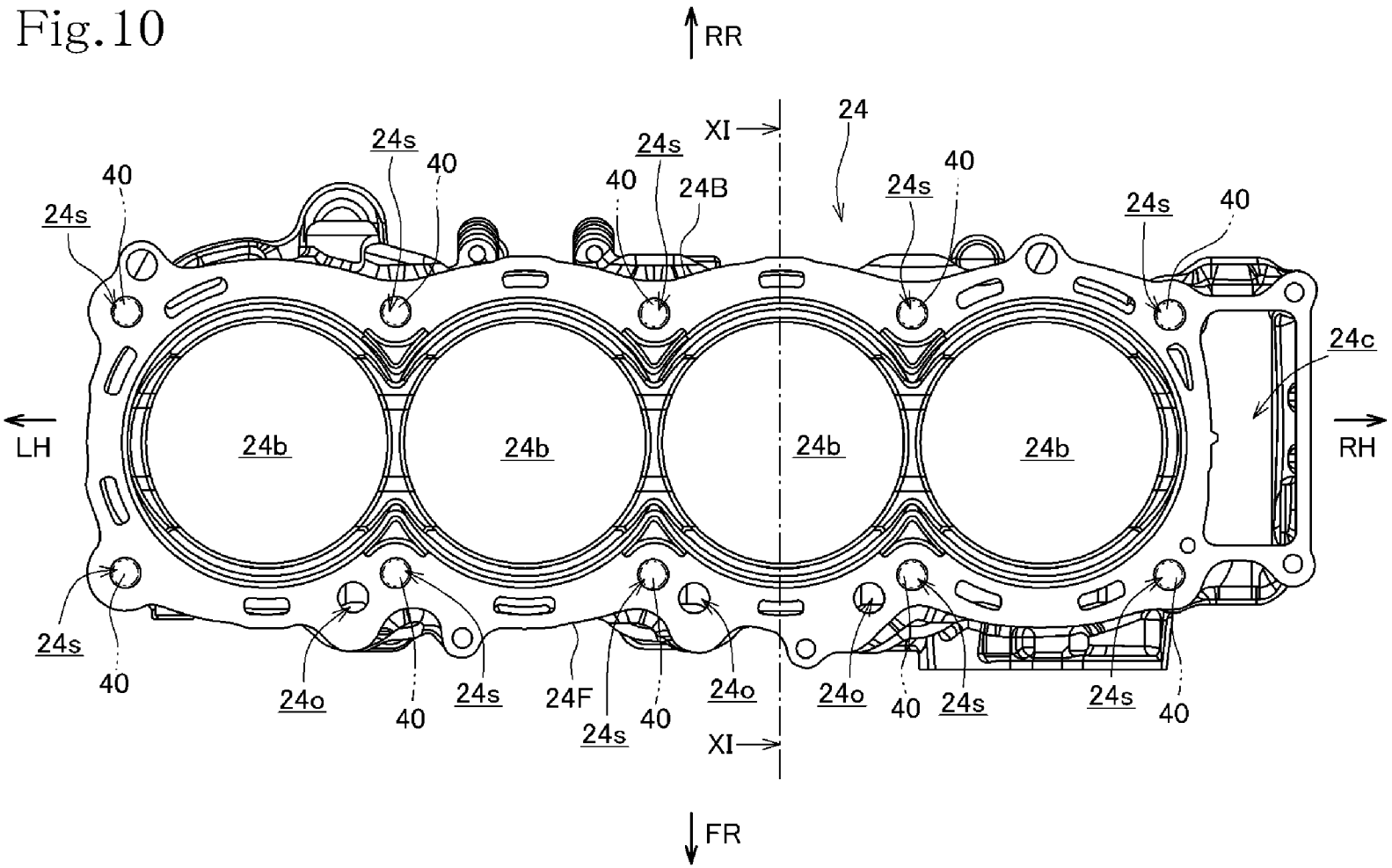
FIG. 10 is a bottom view of the cylinder block.

Meanwhile, the in-cylinder-block upper channel 24Wa of the in-cylinder-head channel 25W of the cylinder block 24 partially opens onto a mating face with the cylinder head 25 (see FIG. 9).

The openings in the mutual mating faces of the cylinder block 24 and the cylinder head 25 face each other, and thus, after the cylinder block 24 and the cylinder head 25 as well as the gasket 25*c* sandwiched between them are stacked and fastened together, the in-cylinder-block upper channel 24Wa and the in-cylinder-head channel 25W fluidly communicate with each other via a communication hole 25*ch* of the gasket 25*c* (see FIG. 12).

On the right side of the crankcase 23 in the engine body 21H of the internal combustion engine 21 as described above, as illustrated in FIG. 3, a water pump 60 is placed under the transmission 31 to circulate cooling water (see FIG. 1, FIG. 2)

The water pump 60 is configured to have an impeller 60*a* housed in a pump body which is formed in a right side wall of the crankcase 23, and the impeller 60*a* is covered from outside with a pump cover 61.

The pump cover 61 has an intake connection tube 62 formed to protrude into an intake chamber on the right hand of the impeller 60*a*. A pump inflow hose 65 is connected to the intake connection tube 62, and the pump inflow hose 65 extends out forward along the right side of the crankcase 23, and then the pump inflow hose 65 turns toward the front of a front wall 24F of the cylinder block 24.

Also, an exhaust connection tube 63 is formed to bend around the perimeter of the impeller 60*a* and then to extend forward. A pump outflow hose 66 is connected to the exhaust connection tube 63, and the pump outflow hose 66 extends out forward along the right side of the crankcase 23, and then the pump outflow hose 66 turns toward the front of the front wall 24F of the cylinder block 24.

Referring to FIG. 2, FIG. 4 and FIG. 5, a thermostat 70 is installed in a left end of the rear of the cylinder head 25 of the engine body 21H, and the thermostat 70 is integrally installed on a rear wall of the cylinder head 25.

Figure 6:
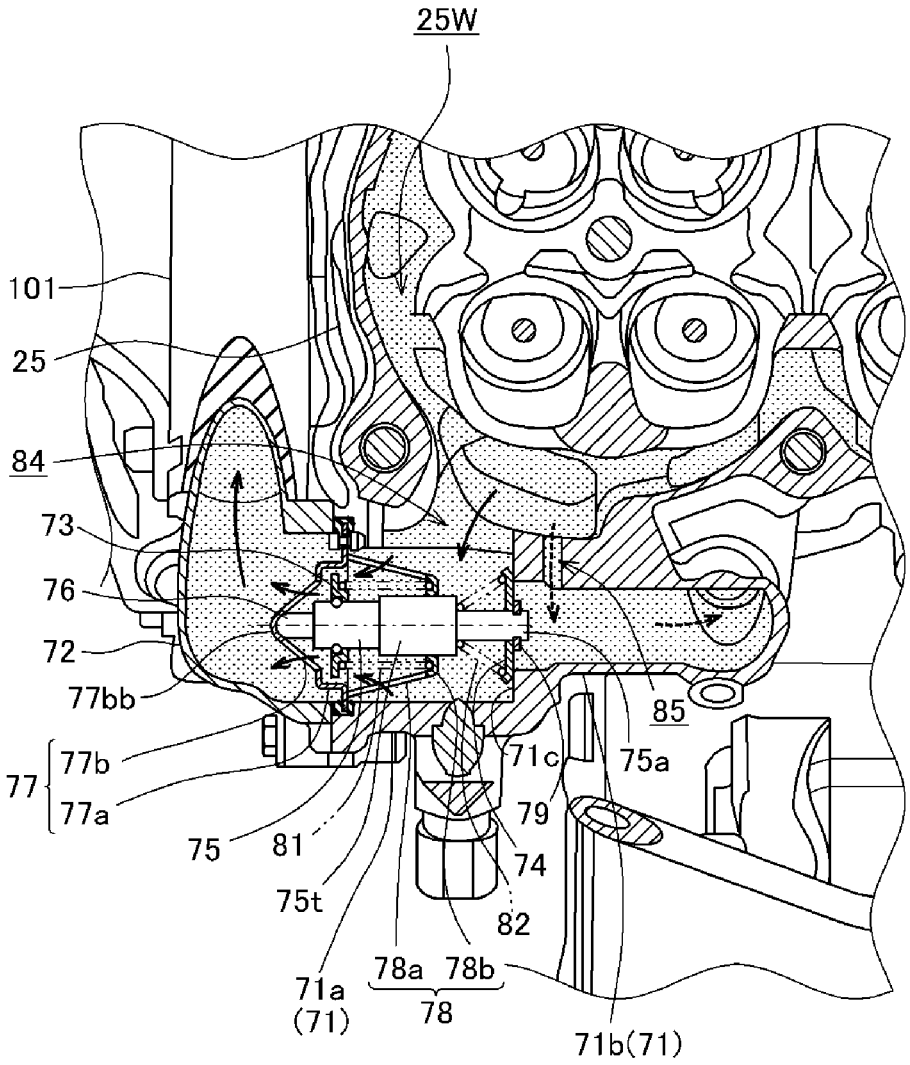
FIG. 6 is an enlarged sectional view illustrating a thermostat and its surroundings under a condition differing from that in FIG. 5.

As illustrated in FIG. 5 and FIG. 6, the thermostat 70 has a thermostat case 71 integrally formed in the rear wall of the cylinder head 25. And, the thermostat case 71 has a left opening covered with a lid member 72, and two valves, i.e., a first valve 73 and a second valve 74, are housed inside the thermostat case 71.

Referring to FIG. 6, in the inside of the thermostat 70, a ring-shaped valve seat 77 is secured by being sandwiched between the thermostat case 71 and the lid member 72. The valve seat 77 integrally includes a ring-shaped seat portion 77*a* and a belt-shaped retainer portion 77*b*. The ring-shaped seat portion 77*a* has a valve opening at the center. The belt-shaped retainer portion 77*b* is bent into a dogleg shape so that both ends of the retainer portions 77*b* are connected to a perimeter edge of the valve opening of the ring-shaped seat portion 77*a*.

The retainer portion 77*b* protrudes into an interior space of the lid member 72 on the left hand from the ring-shaped seat portion 77*a* of the valve seat 77.

A spring shoe support member 78 extends from the ring-shaped seat portion 77*a* of the valve seat 77 into the thermostat case 71 on the right hand.

The spring shoe support member 78 has a ring-shaped spring shoe portion 78*b* formed at a right end of a pair of supporting pieces 78*a*, 78*a* which extend rightward from the valve seat 77.

The first valve 73 abuts on the ring-shaped seat portion 77*a* of the valve seat 77 by being biased by a coil spring 81 that is supported at one end on the spring shoe portion 78*b* of the spring shoe support member 78.

The first valve 73 is attached by passing through a thermoelement 75. A left end of the thermoelement 75 passes loosely through the central valve opening of the ring-shaped valve seat 77. The first valve 73 abuts on the ring-shaped seat portion 77*a* of the valve seat 77, and thereupon the valve opening of the valve seat 77 is blocked to change to the closed state, so that a partition is provided between the internal space of the thermostat case 71 and the interior space of the lid member 72.

A larger diameter right portion of the thermoelement 75 is configured as a sealed temperature sensor 75*t* containing a thermal expansion element such as wax or the like.

In the thermoelement 75, the temperature sensor 75*t* is slidably supported by the ring-shaped spring shoe portion 78*b* of the spring shoe support member 78. Meanwhile, a plunger 76 projects from a left end of the thermoelement 75 toward the interior of the lid member 72 on the left hand, and a distal end of the plunger 76 is held to abut on a bending shoe 77*bb* of the retainer portion 77*b* which is integrally formed on the valve seat 77.

A support rod 75*a* integrally projects rightward from the temperature sensor 75*t* of the thermoelement 75, and the second valve 74 is slidably fitted over the support rod 75*a* to be axially supported.

The second valve 74 is restricted to move by a snap ring 79 engaged on the support rod 75*a*, and the second valve 74 is biased rightward by a cone-shaped coil spring 82 interposed between the second valve 74 and the temperature sensor 75*t*.

The thermostat case 71 has a large-diameter cylinder body 71*a* located on the lid-member-72 side (on the left side), and the thermostat case 71 has a small-diameter cylinder end portion 71*b* with a decreased diameter, the cylinder end portion 71*b* being protrusively provided on the right side of the cylinder body 71*a*.

The second valve 74 is closed by abutting on a shoulder 71*c* between the cylinder body 71*a* and the small-diameter cylinder end portion 71*b*, and thereby, a partition between the interior space of the cylinder body 71*a* and the interior space of the small-diameter cylinder end portion 71*b* is provided.

FIG. 5 illustrates the state when the cooling water temperature is low around the temperature sensor 75*t* of the thermoelement 75. In FIG. 5, the first valve 73 and the thermoelement 75 are forced to move leftward by the coil spring 81, so that the first valve 73 closes by abutting on the valve seat 77, and thus a partition is provided between the interior space of the thermostat case 71 and the interior space of the lid member 72. At the same time, the second valve 74, which is axially supported by the support rod 75*a* of the thermoelement 75, opens by moving away from the shoulder 71*c* between the cylinder body 71*a* and the small-diameter cylinder end portion 71*b* of the thermostat case 71, so as to provide fluid communication between the internal space of the cylinder body 71*a* and the internal space of the small-diameter cylinder end portion 71*b*.

As the cooling water temperature rises around the temperature sensor 75*t* of the thermoelement 75, the wax in the temperature sensor 75*t* expands to push the plunger 76. Thereupon, because the distal end of the plunger 76 is held by the retainer portion 77*b* of the valve seat 77, a reaction force causes the thermoelement 75 to move rightward against the coil spring 81 as illustrated in FIG. 6.

Therefore, the first valve 73 opens to provide fluid communication between the interior space of the thermostat case 71 and the interior space of the lid member 72, and simultaneously, the second valve 74 is biased by the cone-shaped coil spring 82 to close by abutting on the shoulder 71*c*, and thus a partition is provided between the interior space of the cylinder body 71*a* and the interior space of the small-diameter cylinder end portion 71*b*.

The lid member 72 in the thermostat 70 has an outflow connection tube 72*j* protrusively formed therein, and the outflow connection tube 72*j* is connected with a radiator inflow hose 101 that extends from the upstream radiator tank 100U of the radiator 100.

Also, the thermostat case 71 of the thermostat 70 is integrally formed in a rear wall 25B of the cylinder head 25. Then, a broad outflow passage 84 extends from the in-cylinder-head channel 25W of the cylinder head 25, and the outflow passage 84 opens into the interior space of the cylinder body 71*a* of the thermostat case 71 (see FIG. 5, FIG. 12).

In other words, the thermostat case 71 is integrally formed in an outflow section in which the outflow passage 84 of the rear wall 25B of the cylinder head 25 is formed.

A bypass communication passage 86 communicates with the interior space of the small-diameter cylinder end portion 71*b* of the thermostat case 71, and the bypass communication passage 86 is formed to extend toward the cylinder block 24 under the rear wall 25B of the cylinder head 25 to open onto the mating face with the cylinder block 24.

It is noted that a narrow escape passage 85 is configured to extend from the in-cylinder-head channel 25W to open into the small-diameter cylinder end portion 71*b*, so that a portion of the cooling water escapes from the in-cylinder-head channel 25W into the small-diameter cylinder end portion 71*b* to flow into the bypass communication passage 86 even while the second valve 74 closes.

Referring to FIG. 7, in the cylinder block 24, a bypass communication passage 87 is formed in a rear wall 24B. The bypass communication passage 87 communicates with the bypass communication passage 86 in the cylinder head 25, and the bypass communication passage 87 opens onto a mating face with the cylinder head 25 and then the bypass communication passage 87 extends downward. The bypass communication passage 86 in the cylinder head 25 and the bypass communication passage 87 in the cylinder block 24 communicate with each other via the communication hole of the gasket 25*c*.

Referring to FIG. 7 and FIG. 8, the bypass communication passage 87 is formed in the rear wall 24B of the cylinder block 24 and the bypass communication passage 87 has a lower end opening that opens into the in-cylinder-block lower channel 24Wb to serve as a lower channel inlet 24Wba leading to the in-cylinder-block lower channel 24Wb.

The lower channel inlet 24Wba leading to the in-cylinder-block lower channel 24Wb is formed in the rear wall 24B of the cylinder block 24.

With the foregoing configuration, in the state when the cooling water temperature is low immediately after startup of the internal combustion engine, as illustrated in FIG. 5, in the thermoelement 75 the first valve 73 closes and the second valve 74 opens. Therefore, the cooling water circulates through the in-cylinder-head channel 25W, and then the cooling water flows from the interior space of the cylinder body 71*a* into the interior space of the small-diameter cylinder end portion 71*b*. Then, the cooling water flows down from the interior space of the small-diameter cylinder end portion 71*b* into the bypass communication passage 86 in the cylinder head 25 and the bypass communication passage 87 in the cylinder block 24, and then the cooling water flows into the in-cylinder-block lower channel 24Wb.

The in-cylinder-block lower channel 24Wb serves as part of the bypass passage.

As the cooling water temperature rises to a certain degree due to the operation of the internal combustion engine, as illustrated in FIG. 5, in the thermoelement 75 the first valve 73 opens and the second valve 74 closes. Therefore, the cooling water circulates through the in-cylinder-head channel 25W, and then the cooling water flows from the interior space of the cylinder body 71*a* through the interior space of the lid member 72 to the radiator inflow hose 101, and thus the cooling water flows into the upstream radiator tank 100U.

It is noted that, even while the second valve 74 closes, a portion of the cooling water escapes from the in-cylinder-head channel 25W through the narrow escape passage 85 into the small-diameter cylinder end portion 71*b* to flow into the bypass communication passage 86.

It is noted that the escape passage 85 may be formed as a groove by partially cutting out a portion of the shoulder 71*c*, the portion abutting on the second valve 74.

Referring to FIG. 7, at a right site of the front wall of the upper perimeter wall 24U in which the in-cylinder-block upper channel 24Wa of the cylinder block 24 is formed, an upper channel inlet 24Waa is formed to cause the cooling water to flow into the in-cylinder-block upper channel 24Wa.

Referring to FIG. 8, then, at a right site of the front wall 24F of the lower perimeter wall 24L in which the in-cylinder-block lower channel 24Wb of the cylinder block 24 is formed, a lower channel outlet 24Wbb is formed to cause the cooling water to flow out from the in-cylinder-block lower channel 24Wb.

Reference is made to FIG. 4 which is the front view of the internal combustion engine 21. The upper channel inlet 24Waa and the lower channel outlet 24Wbb are placed side by side adjacent to each other in the right site of the front wall 24F of the cylinder block 24.

An upper channel inflow connection tube 91 is connected to the upper channel inlet 24Waa, and a lower channel outflow connection tube 92 is connected to the lower channel outlet 24Wbb. The upper channel inflow connection tube 91 and the lower channel outflow connection tube 92 have a common mounting seat plate 93. The mount seat plate 93 is screwed to the front wall 24F of the cylinder block 24 with bolts. Thereby, the upper channel inflow connection tube 91 and the lower channel outflow connection tube 92 are integrally attached to the front wall 24F of the cylinder block 24.

Referring to FIG. 4, the upper channel inflow connection tube 91 is connected with the pump outflow hose 66 which extends forward from the water pump 60 toward the front of the front wall 24F of the cylinder block 24.

The different pump inflow hose 65 also extends forward from the water pump 60 toward front of the front wall 24F of the cylinder block 24, and the pump inflow hose 65 is connected through a branch connection tube 94 to a radiator outflow hose 102 which leads the cooling water flowing out from the downstream radiator tank 100L of the radiator 100.

As illustrated in FIG. 4, the lower channel outflow connection tube 92 is integrally formed to branch to the branch connection tube 94.

In other words, a branch tube portion of the branch connection tube 94 serves as the lower channel outflow connection tube 92.

Therefore, the upper channel inflow connection tube 91, the lower channel outflow connection tube 92 and the branch connection tube 94 are integrally formed to constitute a connection tube assembly 90.

Figure 14:
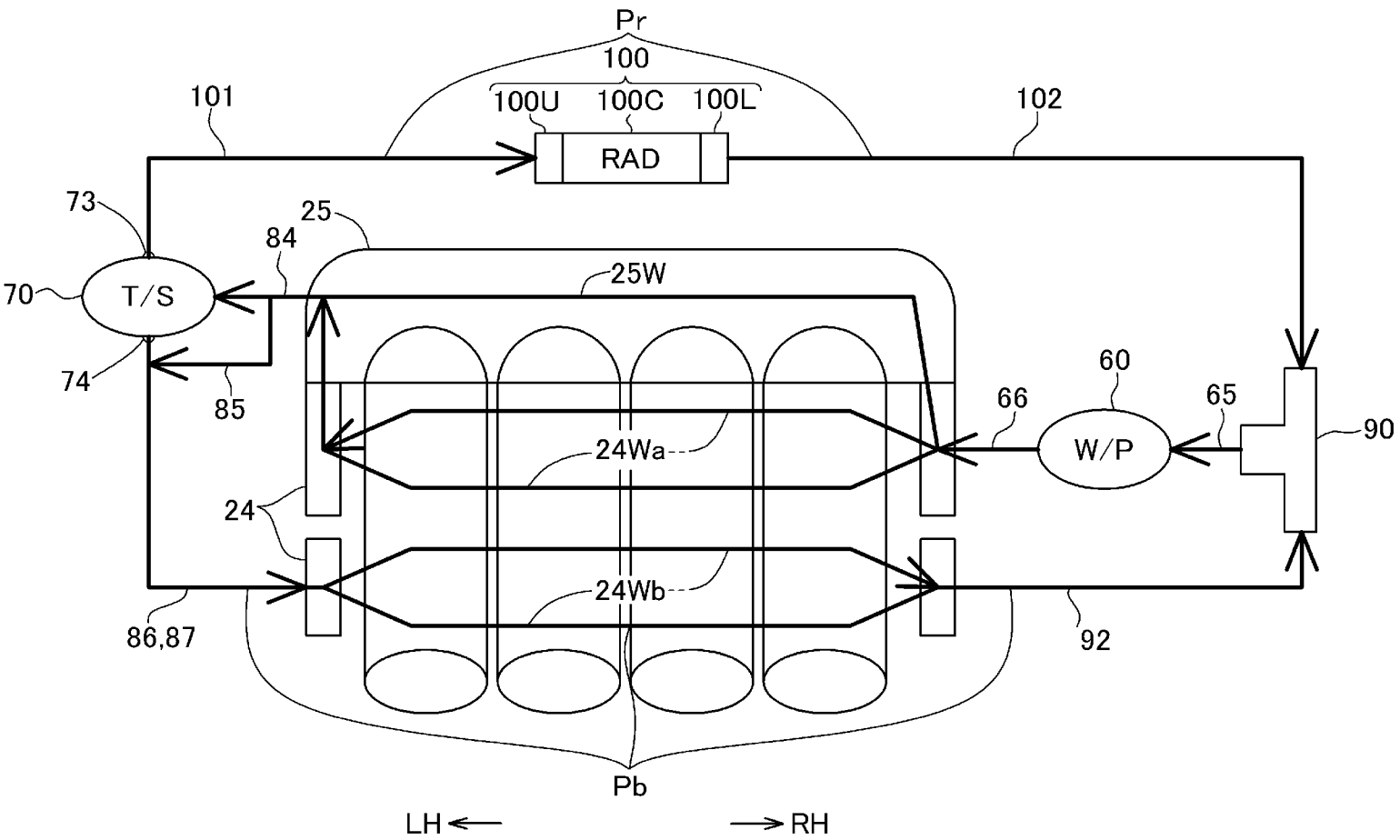
FIG. 14 is a schematic diagram illustrating schematically the flow of cooling water in the cooling structure of the internal combustion engine.

FIG. 14 schematically shows the flow of cooling water in the above-described cooling structure of the internal combustion engine 21.

The thermostat 70 and the water pump 60 are placed separately on the left and right sides of the engine body 21H. Then, the thermostat 70 on the left side of the engine body 21H, and the upstream radiator tank 100U on the same left side of the radiator 100 are connected to each other through the radiator inflow hose 101.

Also, the water pump 60 on the right side of the engine body 21H, and the downstream radiator tank 100L on the same right side of the radiator 100 are connected to each other through the radiator outflow hose 102 and the pump inflow hose 65.

A via-radiator passage Pr passing through the radiator 100 is made up of: the radiator inflow hose 101 through which the cooling water flows from the thermostat 70 on the left side into the upstream radiator tank 100U of the radiator 100; and the radiator outflow hose 102 and the pump inflow hose 65 through which the cooling water flows out from the downstream radiator tank 100L of the radiator 100 to the water pump 60 on the right side. And, the via-radiator passage Pr is closed/opened by the first valve 73 of the thermostat 70.

A bypass passage Pb bypasses the radiator 100 between the thermostat 70 and the water pump 60, and the bypass passage Pb is made up of the bypass communication passages 86, 87, the in-cylinder-block lower channel 24Wb, and the lower channel outflow connection tube 92. And the bypass passage Pb is closed/opened by the second valve 74 of the thermostat 70.

In this manner, because the bypass passage Pb is configured by utilizing the in-cylinder-block lower channel 24Wb, only the lower channel outflow connection tube 92 is required as external piping, and therefore a significant reduction in external piping is achieved.

Thus, the bypass passage Pb is partially composed of the in-cylinder-block lower channel 24Wb of the cylinder block 24. This facilitates forming the bypass passage, and also a reduction in external piping for the bypass passage Pb is achieved. In turn, a low component count and simplified structure will offer a reduction in cost and a reduction in weight of the internal combustion engine. In addition, the surroundings of the engine body can be simplified to maintain favorable external appearances.

During the warm-up operation for engine start-up with low temperatures of the cooling water, the thermostat 70 closes the first valve 73, while the thermostat 70 opens the second valve 74. Therefore, after cooling water is discharged from the water pump 60, the cooling water flows along the circulation path in which: the cooling water flows through the pump outflow hose 66 into the in-cylinder-block upper channel 24Wa; then, the cooling water flows from the in-cylinder-block upper channel 24Wa through the communication hole 25*ch* into the in-cylinder-head channel 25W to circulate through the in-cylinder-block upper channel 24Wa and the in-cylinder-head channel 25W; then, the cooling water flows from the outflow passage 84 into the cylinder body 71*a* of the thermostat 70; then the cooling water flows from the opening second valve 74 into the bypass communication passages 86, 87; then the cooling water flows through the in-cylinder-block lower channel 24Wb serving as part of the bypass passage Pb; and then the cooling water flows through the lower channel outflow connection tube 92 back to the water pump 60.

In this way, after the cooling water is heated by flowing through the in-cylinder-block upper channel 24Wa and the in-cylinder-head channel 25W, when the cooling water flows through the bypass channel Pb that bypasses the radiator 100, the cooling water is further heated in the in-cylinder-block lower channel 24Wb although heat dissipation is reduced to a minimum by dissipating heat from only the lower channel outflow connection tube 92 of a short length due to a reduction in external piping. Because of this, further temperature rise can be caused to accelerate warming up more and more.

As the cooling water temperature rises to a certain degree due to the warm-up operation of the internal combustion engine 21, the thermostat 70 closes the second valve 74, while the thermostat 70 opens the first valve 73 to enter normal operation. Therefore, after cooling water is discharged from the water pump 60, the cooling water flows along the circulation path in which: the cooling water circulates from the pump outflow hose 66 through the in-cylinder-block upper channel 24Wa and the in-cylinder-head channel 25W; then the cooling water flows from the outflow passage 84 into the cylinder body 71*a* of the thermostat 70; then the cooling water flows from the opening first valve 73 through the via-radiator passage Pr that passes through the radiator 100; and then the cooling water flows back to the water pump 60.

In this way, after the cooling water is cooled by the radiator 100, the cooling water can flow through the in-cylinder-block upper channel 24Wa and the in-cylinder-head channel 25W to cool the cylinder block 24 and the cylinder head 25.

It should be noted that, in normal operation after warm-up operation of the internal combustion engine 21, even while the second valve 74 of the thermostat 70 closes, the cooling water escapes into the bypass communication passage 86 through the narrow escape passage 85, so that, even if only slightly, the cooling water is caused to flow through the bypass passage in order to prevent the cooling water from becoming stagnant within the in-cylinder-block lower channel 24Wb.

One embodiment of the cooling structure of the internal combustion engine according to the present invention has been described above in details. In the embodiment, the following advantageous effects are produced.

As illustrated in FIG. 11 and FIG. 12, the in-cylinder-block channel 24W through which the cooling water flows around the cylinder bores 24*b* within the cylinder block 24 is partitioned up and down in the axis direction of the cylinder axis Lc by the partition wall 24P to form the in-cylinder-block upper channel 24Wa and the in-cylinder-block lower channel 24Wb. And, the in-cylinder-block lower channel 24Wb of the in-cylinder-block channel 24W through which the cooling water flows around the cylinder bores 24*b* of the cylinder block 24 is used as a part of the bypass passage Pb. Because of this, the greater part of the bypass passage Pb can be configured in the wall of the cylinder block 24 without an increase in the size of the internal combustion engine. This contributes to the achievement of space savings and enhancement in external appearances.

As illustrated in FIG. 8, the in-cylinder-block lower channel 24Wb serving as the bypass passage is formed in a ring shape in such a manner as to surround the outer periphery of the cylinder bores 24*b* of the cylinder block 24. Because of this, the cooling water flowing in the bypass passage Pb efficiently receives heat to achieve an early rise in temperature. This results in more acceleration of early warming up.

As illustrated in FIG. 2 and FIG. 3, the radiator 100, which is placed in front of the internal combustion engine 21, is a side tank radiator that has the radiator tanks 100U, 100L situated left and right on opposite sides of the radiator core 100C. The thermostat 70 on the left side of the engine body 21H, and the upstream radiator tank 100U on the same left side are connected to each other through the radiator inflow hose 101. The water pump 60 on the right side of the engine body, and the downstream radiator tank 100L on the same right side are connected to each other through the radiator outflow hose 102. Because of this, the left radiator inflow hose 101 and the right radiator outflow hose 102 can be made as short as possible.

As illustrated in FIG. 12, the partition wall 24P, which partitions the in-cylinder-block channel 24W, is formed in a location closer to the crankcase 23 than a midpoint of the piston-top motion range Dp of motion of the piston top 28*t* of the piston 28 that slides in the direction of the cylinder axis Lc within the cylinder bore 24*b* of the cylinder block 24. Because of this, the in-cylinder-block upper channel 24Wa has a greater capacity than that of the in-cylinder-block lower channel 24Wb, and, during normal operation after the warming up of the internal combustion engine 21, the cooling water routed through the radiator 100 flows through the in-cylinder-block upper channel 24Wa with a greater capacity, and thereby the cylinder block 24 can be cooled with efficiency.

As illustrated in FIG. 5, the in-cylinder-block upper channel 24Wa and the in-cylinder-head channel 25W communicate with each other through the communication hole 25*ch* of the gasket 25*c*, and the thermostat case 71 of the thermostat 70 is integrally formed in the cylinder head 25 in the outflow section in which the outflow passage 84 of the in-cylinder-head channel 25W is located. Because of this, a reduction in the component count can be enabled, and also the thermostat 70 can be installed in the cylinder head 25 in a compact manner, and thereby an increase in the size of the internal combustion engine 21 can be inhibited.

As illustrated in FIG. 5, the thermostat 70 causes the cooling water flowing out from the in-cylinder-head channel 25W to flow to either the via-radiator passage Pr or the bypass passage Pb in a selective manner, and also the thermostat 70 includes the escape passage 85 through which a portion of the cooling water flowing out from the in-cylinder-head channel 25W escapes into the bypass passage Pb at all times. Because of this, during normal operation after the warming up of the internal combustion engine 21, even when the thermostat 70 causes the cooling water to flow into the via-radiator passage Pr, but not into the bypass passage Pb, a portion of the cooling water is caused to flow from the escape passage 85 into the in-cylinder-block lower channel 24Wb serving as the bypass passage Pb. Thus, stagnation of the cooling water can be avoided to prevent the cooling water in the in-cylinder-block lower channel 24Wb from coming to a boil.

As illustrated in FIG. 4, the lower channel inlet 24Wba in the in-cylinder-block lower channel 24Wb serving as part of the bypass passage Pb is formed in the front wall 24F of the cylinder block 24. Because of this, it is possible to inhibit the size of the internal combustion engine 21 from being increased in the left-right, vehicle width direction.

As illustrated in FIG. 4, the lower channel outflow connection tube 92 connected to the lower channel outlet 24Wbb of the in-cylinder-block lower channel 24Wb, and the upper channel inflow connection tube 91 connected to the upper channel inlet 24Waa of the in-cylinder-block upper channel 24Wa are integrally formed. Because of this, a reduction in component count and an improvement in mountability can be achieved.

As illustrated in FIG. 4, the branch connection tube 94 is connected between the radiator outflow piping 102 and the pump inflow hose 65 through which the cooling water flows back to the water pump 60, and the branch connection tube 94 integrally has the lower channel outflow connection tube 92 as a branch tube portion of the branch connection tube 94. This results in the configuration of the connection tube assembly 90 (the cross-hatching shaded area of FIG. 4) in which the branch connection tube 94 connected between the radiator outflow piping 102 and the pump inflow hose 65, the lower channel outflow connection tube 92 and the upper channel inflow connection tube 91 are integrally formed. And, a reduction in component count and an improvement in mountability can be achieved.

As illustrated in FIG. 8 and FIG. 13, the in-cylinder-block lower channel 24Wb serving as part of the bypass passage Pb is formed to extend on the outward side of the stud bolts 40, namely, on the opposite side of the stud bolts 40 from the cylinder bores 24*b*. Because of this, the greater rigid fastening is accomplished with the stud bolts 40 on the lower side of the cylinder block 24 attached to the crankcase 23, so that the cylinder block 24 can be securely attached to the crankcase 23. And also, greater rigidity and uniform surface pressure can be achieved on the gasket surface between the crankcase 23 and the cylinder block 24 to improve the sealing characteristics.

The cooling structure of the internal combustion engine according to one embodiment according to the present invention has been described. However, it should be understood that aspects of the present invention are not limited to the embodiment described above, and include what is implemented in a variety of aspects within the scope and spirit of the present invention.

Are included, for example, an aspect of a cooling structure of an internal combustion engine in which the flow of cooling water differs, such as both the thermostat and the water pump being arranged on either left or right side of the engine body, and the like.

Also, are included an aspect of a cooling structure of an internal combustion engine in which the thermostat is placed separately from the cylinder head and the thermostat and the cylinder head are coupled through a cooling hose, and the like.

REFERENCE SIGNS LIST

1 . . . Motorcycle
2 . . . Body frame
3 . . . Head pipe
4 . . . Main frame
5 . . . Down frame
6 . . . Seat rail
7 . . . Front fork
8 . . . Handlebar
9 . . . Front wheel
10 . . . Pivot shaft
11 . . . Rear fork
12 . . . Rear wheel
13 . . . Link mechanism
14 . . . Rear cushion
15 . . . Fuel tank
16 . . . Seat
20 . . . Power unit
21 . . . Internal combustion engine
21H . . . Engine body
22 . . . Crankshaft
23 . . . Crankcase
24 . . . Cylinder block
24F . . . Front wall
24B . . . Rear wall
24U . . . Upper perimeter wall
24L . . . Lower perimeter wall
24*b* . . . Cylinder bore
24W . . . In-cylinder-block channel (cylinder-block water jacket)
24Wa . . . In-cylinder-block upper channel
24Waa . . . Upper channel inlet
24Wb . . . In-cylinder-block lower channel
24Wba . . . Lower channel inlet
24Wbb . . . Lower channel outlet
24P . . . Partition wall
24*o* . . . Oil passage
25 . . . Cylinder head
25B . . . Rear wall
25W . . . In-cylinder-head channel (cylinder-head water jacket)
25*c* . . . Gasket
25*ch* . . . Communication hole
26 . . . Cylinder head cover
27 . . . Oil pan
28 . . . Piston
31 . . . Transmission
32 . . . Main shaft
33 . . . Counter shaft (output shaft)
34 . . . Output sprocket
35 . . . Driven sprocket
36 . . . Drive chain
40 . . . Stud bolt
50 . . . Intake pipe
51 . . . Throttle body
52 . . . Air cleaner
55 . . . Exhaust pipe
56 . . . Catalyst Device
57 . . . Muffler
60 . . . Water pump
61 . . . Pump cover
62 . . . Intake connection tube
63 . . . Exhaust connection tube
65 . . . Pump inflow hose
66 . . . Pump outflow hose
70 . . . Thermostat
71 . . . Thermostat case
71*a* . . . Cylinder body
71*b* . . . Small-diameter cylinder end portion
71*c* . . . Shoulder
72 . . . Lid member
73 . . . First valve
74 . . . Second valve
75 . . . Thermoelement
75*t* . . . Temperature sensor
76 . . . Plunger
77 . . . Valve seat
78 . . . Spring shoe support member
79 . . . Snap ring
81 . . . Coil spring
82 . . . Cone-shaped coil spring
84 . . . Outflow passage
85 . . . Escape passage
86 . . . Bypass communication passage
87 . . . Bypass communication passage
90 . . . Connection tube assembly
91 . . . Upper channel inflow connection tube
92 . . . Lower channel outflow connection tube
93 . . . Mount seat plate
94 . . . Branch connection tube
100 . . . Radiator
100C . . . Radiator core
100U . . . Upstream radiator tank
100L . . . Downstream radiator tank
101 . . . Radiator inflow hose (coolant piping)
102 . . . Radiator outflow hose (coolant piping)

The invention claimed is:

1. A cooling structure of an internal combustion engine, in which said internal combustion engine is mounted at a center in a left-right vehicle-width direction of a vehicle body between a front wheel and a rear wheel of a motorcycle, said internal combustion engine has an engine body configured to place a cylinder block and a cylinder head in this order on a crankcase, said cylinder block has an in-cylinder-block fluid passage through which a coolant flows around a cylinder bore, said cylinder head has an in-cylinder-head fluid passage through which said coolant flows around a combustion chamber, said in-cylinder-head fluid passage includes an escape passage through which a portion of said coolant flowing out from said in-cylinder-head fluid passage escapes into said bypass passage at all times, and a via-radiator passage passing through a radiator air-cooling said coolant and a bypass passage bypassing said radiator are installed to a coolant circulation path circulating said coolant through said in-cylinder-block fluid passage and said in-cylinder-head fluid passage by a coolant pump, said cooling structure of said internal combustion engine, comprising a thermostat provided to switch between a circulation by way of said via-radiator passage and a circulation by way of said bypass passage, wherein said in-cylinder-block fluid passage is partitioned up and down in an axis direction of a cylinder axis into an in-cylinder-block upper fluid passage and an in-cylinder-block lower fluid passage by a partition wall, said cylinder axis being a central axis of said cylinder bore, and said bypass passage is partially composed of said in-cylinder-block lower fluid passage.

2. The cooling structure of the internal combustion engine as claimed in claim 1, wherein said in-cylinder-block lower fluid passage is formed in a ring shape surrounding an outer periphery of said cylinder bore of said cylinder block.

3. The cooling structure of the internal combustion engine as claimed in claim 2, wherein said radiator has radiator tanks situated left and right on opposite sides of a radiator core, and said radiator is placed in front of said internal combustion engine, said thermostat and said coolant pump are placed separately on left and right sides in said left-right vehicle-width direction of said engine body, said thermostat on either left or right side of said engine body, and said radiator tank on the same left or right side are connected to each other through a coolant piping, and said coolant pump on the other left or right side of said engine body and said radiator tank on the same left or right side are connected to each other through a coolant piping.

4. The cooling structure of the internal combustion engine as claimed in claim 2, wherein said partition wall partitioning said in-cylinder-block fluid passage is located closer to said crankcase than a midpoint of a piston-top motion range of motion of a piston top of a piston that slides in said cylinder bore of said cylinder block in the axis direction of said cylinder axis.

5. The cooling structure of the internal combustion engine as claimed in claim 2, wherein said in-cylinder-block upper fluid passage and said in-cylinder-head fluid passage communicate with each other via a communication hole of a gasket which is sandwiched between said cylinder block and said cylinder head, and said thermostat has a thermostat case that is integrally formed in said cylinder head in an outflow section of said in-cylinder-head fluid passage.

6. The cooling structure of the internal combustion engine as claimed in claim 5, wherein said thermostat is operative to cause said coolant flowing out from said in-cylinder-head fluid passage to flow to either said via-radiator passage or said bypass passage in a selective manner.

7. The cooling structure of the internal combustion engine as claimed in claim 2, wherein said in-cylinder-block lower fluid passage serving as part of said bypass passage has a lower fluid passage inlet formed therein, and said lower fluid passage inlet is formed in either a front wall or a rear wall of said cylinder block.

8. The cooling structure of the internal combustion engine as claimed in claim 2, wherein said in-cylinder-block lower fluid passage has a lower fluid passage outlet formed therein, said in-cylinder-block upper fluid passage has an upper fluid passage inlet formed therein, and said lower fluid passage outlet and said upper fluid passage inlet are formed adjacent to each other in said front wall of said cylinder block, and said lower fluid passage outlet is connected to a lower fluid passage outflow connection tube, said upper fluid passage inlet is connected to an upper fluid passage inflow connection tube, and said lower fluid passage outflow connection tube and said upper fluid passage inflow connection tube are integrally formed.

9. The cooling structure of the internal combustion engine as claimed in claim 8, wherein said coolant flowing out from said radiator is led by a radiator outflow piping, said coolant flows back to said coolant pump through a pump inflow piping, a branch connection tube is connected between said radiator outflow piping and said pump inflow piping, and said branch connection tube integrally has said lower fluid passage outflow connection tube as a branch tube portion of said branch connection tube.

10. The cooling structure of the internal combustion engine as claimed in claim 2, wherein said engine body is configured to place said cylinder block and said cylinder head in this order on said crankcase and then to fasten said crankcase, said cylinder block and said cylinder head together with stud bolts, and said in-cylinder-block lower fluid passage serving as a part of said bypass passage extends on an outward side of said stud bolts opposite to said cylinder bore with respect to said stud bolt.

11. The cooling structure of the internal combustion engine as claimed in claim 1, wherein said radiator has radiator tanks situated left and right on opposite sides of a radiator core, and said radiator is placed in front of said internal combustion engine, said thermostat and said coolant pump are placed separately on left and right sides in said left-right vehicle-width direction of said engine body, said thermostat on either left or right side of said engine body, and said radiator tank on the same left or right side are connected to each other through a coolant piping, and said coolant pump on the other left or right side of said engine body and said radiator tank on the same left or right side are connected to each other through a coolant piping.

12. The cooling structure of the internal combustion engine as claimed in claim 1, wherein said partition wall partitioning said in-cylinder-block fluid passage is located closer to said crankcase than a midpoint of a piston-top motion range of motion of a piston top of a piston that slides in said cylinder bore of said cylinder block in the axis direction of said cylinder axis.

13. The cooling structure of the internal combustion engine as claimed in claim 1, wherein said in-cylinder-block upper fluid passage and said in-cylinder-head fluid passage communicate with each other via a communication hole of a gasket which is sandwiched between said cylinder block and said cylinder head, and said thermostat has a thermostat case that is integrally formed in said cylinder head in an outflow section of said in-cylinder-head fluid passage.

14. The cooling structure of the internal combustion engine as claimed in claim 1, wherein said in-cylinder-block lower fluid passage serving as part of said bypass passage has a lower fluid passage inlet formed therein, and said lower fluid passage inlet is formed in either a front wall or a rear wall of said cylinder block.

15. The cooling structure of the internal combustion engine as claimed in claim 1, wherein said engine body is configured to place said cylinder block and said cylinder head in this order on said crankcase and then to fasten said crankcase, said cylinder block and said cylinder head together with stud bolts, and said in-cylinder-block lower fluid passage serving as a part of said bypass passage extends on an outward side of said stud bolts opposite to said cylinder bore with respect to said stud bolt.

16. A cooling structure of an internal combustion engine, in which:

said internal combustion engine is mounted at a center in a left-right vehicle-width direction of a vehicle body between a front wheel and a rear wheel of a motorcycle, said internal combustion engine has an engine body configured to place a cylinder block and a cylinder head in this order on a crankcase, said cylinder block has an in-cylinder-block fluid passage through which a coolant flows around a cylinder bore, said cylinder head has an in-cylinder-head fluid passage through which said coolant flows around a combustion chamber, and a via-radiator passage passing through a radiator air-cooling said coolant and a bypass passage bypassing said radiator are installed to a coolant circulation path circulating said coolant through said in-cylinder-block fluid passage and said in-cylinder-head fluid passage by a coolant pump, said cooling structure of said internal combustion engine, comprising a thermostat provided to switch between a circulation by way of said via-radiator passage and a circulation by way of said bypass passage, wherein:

said in-cylinder-block fluid passage is partitioned up and down in an axis direction of a cylinder axis into an in-cylinder-block upper fluid passage and an in-cylinder-block lower fluid passage by a partition wall, said cylinder axis being a central axis of said cylinder bore, said bypass passage is partially composed of said in-cylinder-block lower fluid passage, said in-cylinder-block upper fluid passage and said in-cylinder-head fluid passage communicate with each other via a communication hole of a gasket which is sandwiched between said cylinder block and said cylinder head, said thermostat has a thermostat case that is integrally formed in said cylinder head in an outflow section of said in-cylinder-head fluid passage, said thermostat is operative to cause said coolant flowing out from said in-cylinder-head fluid passage to flow to either said via-radiator passage or said bypass passage in a selective manner, and said in-cylinder-head fluid passage includes an escape passage through which a portion of said coolant flowing out from said in-cylinder-head fluid passage escapes into said bypass passage at all times.

17. A cooling structure of an internal combustion engine, in which said internal combustion engine is mounted at a center in a left-right vehicle-width direction of a vehicle body between a front wheel and a rear wheel of a motorcycle, said internal combustion engine has an engine body configured to place a cylinder block and a cylinder head in this order on a crankcase, said cylinder block has an in-cylinder-block fluid passage through which a coolant flows around a cylinder bore, said cylinder head has an in-cylinder-head fluid passage through which said coolant flows around a combustion chamber, and a via-radiator passage passing through a radiator air-cooling said coolant and a bypass passage bypassing said radiator are installed to a coolant circulation path circulating said coolant through said in-cylinder-block fluid passage and said in-cylinder-head fluid passage by a coolant pump, said cooling structure of said internal combustion engine, comprising a thermostat provided to switch between a circulation by way of said via-radiator passage and a circulation by way of said bypass passage, wherein:

said in-cylinder-block fluid passage is partitioned up and down in an axis direction of a cylinder axis into an in-cylinder-block upper fluid passage and an in-cylinder-block lower fluid passage by a partition wall, said cylinder axis being a central axis of said cylinder bore, said bypass passage is partially composed of said in-cylinder-block lower fluid passage, said in-cylinder-head fluid passage includes an escape passage through which a portion of said coolant flowing out from said in-cylinder-head fluid passage escapes into said bypass passage at all times, said in-cylinder-block lower fluid passage has a lower fluid passage outlet formed therein, said in-cylinder-block upper fluid passage has an upper fluid passage inlet formed therein, and said lower fluid passage outlet and said upper fluid passage inlet are formed adjacent to each other in said front wall of said cylinder block, and said lower fluid passage outlet is connected to a lower fluid passage outflow connection tube, said upper fluid passage inlet is connected to an upper fluid passage inflow connection tube, and said lower fluid passage outflow connection tube and said upper fluid passage inflow connection tube are integrally formed.

18. The cooling structure of the internal combustion engine as claimed in claim 17, wherein said coolant flowing out from said radiator is led by a radiator outflow piping, said coolant flows back to said coolant pump through a pump inflow piping, a branch connection tube is connected between said radiator outflow piping and said pump inflow piping, and said branch connection tube integrally has said lower fluid passage outflow connection tube as a branch tube portion of said branch connection tube.

* * * * *